US010030926B2

(12) United States Patent
Mather et al.

(10) Patent No.: US 10,030,926 B2
(45) Date of Patent: Jul. 24, 2018

(54) TRIGGER HOUSING MOUNTING SYSTEM FOR FIREARM

(71) Applicant: Sturm, Ruger & Company, Inc., Southport, CT (US)

(72) Inventors: Jonathan Philip Mather, Grafton, NH (US); Adam Jay Taylor, Unity, NH (US); Benjamin K. Parker, Manchester, NH (US); Shane M. Bernier, Goshen, NH (US); David B. Kangas, Claremont, NH (US)

(73) Assignee: STURM, RUGER & COMPANY, INC.

( * ) Notice: Subject to any disclaimer, the term of this patent is extended or adjusted under 35 U.S.C. 154(b) by 294 days.

(21) Appl. No.: 15/002,582

(22) Filed: Jan. 21, 2016

(65) Prior Publication Data

US 2016/0187092 A1 Jun. 30, 2016

Related U.S. Application Data

(63) Continuation-in-part of application No. 14/980,563, filed on Dec. 28, 2015, now Pat. No. 9,441,897.

(60) Provisional application No. 62/105,925, filed on Jan. 21, 2015, provisional application No. 62/096,981, filed on Dec. 26, 2014.

(51) Int. Cl.

| | |
|---|---|
| ***F41A 19/10*** | (2006.01) |
| ***F41A 3/66*** | (2006.01) |
| ***F41A 11/02*** | (2006.01) |
| ***F41A 17/46*** | (2006.01) |

(52) U.S. Cl.

CPC ..... *F41A 19/10* (2013.01); *F41A 3/66* (2013.01); *F41A 11/02* (2013.01); *F41A 17/46* (2013.01)

(58) Field of Classification Search

CPC .. F41A 19/10; F41A 19/16; F41A 3/66; F41A 11/02; F41A 17/46

USPC ..... 42/69.02, 69.01

See application file for complete search history.

(56) References Cited

U.S. PATENT DOCUMENTS

| | | | | | |
|---|---|---|---|---|---|
| 84,224 | A | * | 11/1868 | Slotterbek | F41A 19/10 42/42.01 |
| 3,386,336 | A | * | 6/1968 | Roy | F41A 3/72 42/75.02 |
| 3,863,375 | A | | 2/1975 | Browning | |
| 4,667,429 | A | * | 5/1987 | Perazzi | F41A 19/16 42/69.01 |
| 5,311,692 | A | * | 5/1994 | Blaser | F41A 19/21 42/42.01 |
| 5,454,182 | A | * | 10/1995 | Lewis | F41C 9/08 42/51 |

(Continued)

OTHER PUBLICATIONS

Corresponding International Search Report and Written Opinion for PCT/US16/14271 dated Apr. 4, 2016.

*Primary Examiner* — Joshua E Freeman

(74) *Attorney, Agent, or Firm* — The Belles Group, P.C.

(57) ABSTRACT

A trigger housing mounting system for a firearm includes a receiver having a mounting slot and cutouts which receive mounting tabs on the trigger housing. The trigger housing is slidable forward and rearward in the receiver between locked and unlocked positions. A spring-biased locking block is movably mounted on the trigger housing. During the mounting process, the locking block is movable between a non-blocking position and a blocking position which prevents removal of the trigger housing from the receiver. A related mounting method is disclosed.

19 Claims, 42 Drawing Sheets

(56) References Cited

U.S. PATENT DOCUMENTS 5,615,507 A * 4/1997 French ..... F41A 17/28 42/69.02
5,657,567 A * 8/1997 Beretta ..... F41A 19/15 42/41
6,347,474 B1 * 2/2002 Wolff, Jr. ..... F41A 19/10 42/69.01
7,302,881 B1 * 12/2007 Tertin ..... F41A 11/02 42/69.02
7,963,062 B1 * 6/2011 Rotharmel ..... F41A 9/25 42/6
8,381,628 B1 * 2/2013 Wheatley ..... F41A 35/06 42/43
8,677,666 B2 * 3/2014 Pichler ..... F41A 17/46 42/70.01
8,756,846 B1 * 6/2014 Lemoine ..... F41A 3/66 42/69.01
8,782,940 B1 * 7/2014 Morris ..... F41A 11/02 42/69.01
9,506,712 B2 * 11/2016 Mather ..... F41A 21/482
9,599,420 B2 * 3/2017 Moretti ..... F41A 19/10
9,658,007 B2 * 5/2017 Withey ..... F41A 3/22
9,766,029 B2 * 9/2017 Dextraze ..... F41A 11/02
2006/0156607 A1 * 7/2006 Curry ..... F41A 19/15 42/69.01
2006/0207149 A1 * 9/2006 Lazor ..... F41A 19/10 42/69.01
2006/0248772 A1 * 11/2006 Curry ..... F41A 19/12 42/69.02
2006/0249014 A1 * 11/2006 Curry ..... F41A 11/00 89/196
2007/0006510 A1 * 1/2007 McCormick ..... F41A 19/10 42/75.02
2009/0071053 A1 3/2009 Thomele et al.
2010/0175291 A1 * 7/2010 Farley, Jr. ..... F41A 19/10 42/69.01
2010/0257768 A1 * 10/2010 Barrett ..... F41A 3/22 42/16
2011/0277367 A1 * 11/2011 Krieger ..... F41A 19/10 42/69.01
2012/0096753 A1 * 4/2012 Pichler ..... F41A 19/12 42/69.01
2012/0180360 A1 * 7/2012 Jones ..... F41A 11/02 42/75.03
2013/0014418 A1 * 1/2013 Dextraze ..... F41A 11/02 42/16
2013/0174459 A1 7/2013 Moretti
2015/0020423 A1 * 1/2015 Withey ..... F41A 3/22 42/16
2015/0323268 A1 * 11/2015 Kokinis ..... F41A 11/02 89/193
2016/0047615 A1 * 2/2016 Tubb ..... F41A 17/56 42/69.01
2016/0061549 A1 * 3/2016 Patterson ..... F41A 17/56 42/69.01
2016/0187092 A1 * 6/2016 Mather ..... F41A 19/10 42/69.02
2016/0202010 A1 * 7/2016 Smith, Jr. ..... F41A 19/10 42/69.01
2016/0258706 A1 * 9/2016 Ollig ..... F41A 33/00
2016/0305730 A1 * 10/2016 Dextraze ..... F41A 19/10
2016/0377363 A1 * 12/2016 Lipowski ..... F41A 19/10 42/69.01

* cited by examiner

TRIGGER HOUSING MOUNTING SYSTEM FOR FIREARM

CROSS-REFERENCE TO RELATED APPLICATIONS

The present application claims the benefit of priority to U.S. Provisional Application No. 62/105,925 filed Jan. 21, 2015, and is a continuation-in-part of U.S. patent application Ser. No. 14/980,563 filed Dec. 28, 2015 which claims the benefit of U.S. Provisional Application No. 62/096,981 filed Dec. 26, 2014; the entireties of which are incorporated herein by reference.

BACKGROUND

The present invention generally relates to firearms, and more particularly to a trigger housing mounting system for a trigger housing which may include a safety selector mechanism suitable for a bolt-action firearm such as a rifle.

On some firearms it is desirable for ergonomic considerations, design constraints, aesthetics, or other reasons, to position a safety selector that controls the firing mode so that it must be contained within the stock assembly or another component that can be separated from the receiver or action. Pistol grips as popularized by the AR-15 genre of rifles (adopted by the U.S. military as the M16 rifle) have been commonly used on other types of modern firearms; often on rifles that were not originally designed for pistol grips. On bolt action rifles modified to add a pistol grip, the safety selector may be left in its original location typically alongside the back of the bolt or on top of the buttstock behind the bolt, which is not easily accessed when holding onto a pistol grip instead of cradling the stock. Hence, while acceptable for bolt action rifles without a pistol grip, this top-mounted safety selector location is inconvenient.

On firearms like the AR-15, where all of the fire-control components are contained in the lower receiver, the safety selector remains in the same relative position and does not hinder disassembly. If the fire-control group of components is connected to the receiver or action, while the safety selector is attached or contained within another component, it may be difficult to separate these components without disassembling additional rifle parts. This is especially true for rotating safety selectors, like used in AR-15 type rifles, where the cross shaft of the safety interacts with or intersects part of the fire-control group to block the firing mechanism. Optimally, the safety mechanism and selector switch should be strategically located to minimize the number of components which need to be disassembled to access to the firearm's firing mechanism.

Accordingly, an improved and more conveniently located safety selector design is desired for rifles with pistol grips other than the AR-15 rifle platform. A trigger housing which is easily detachable from and lockable to the receiver is further desirable

SUMMARY

A firearm according to the present disclosure includes a detachable trigger housing with safety mechanism which allows the safety selector to be mounted in a removable stock component separate from the firing mechanism assembly mounted in a trigger housing, but can still be easily separated without additional disassembly of safety or fire-control components. In one implementation, the safety selector allows selection of a "safe" firing mode in which the firing mechanism is disabled and a "fire" firing mode in which the firing mechanism is enabled to discharge the firearm. The concept also prevents the stock component and trigger housing from being separated from the receiver unless the safety selector is in the "safe" position. When designed around an AR-15 compatible safety shaft, like the design described herein, the safety selector can be installed for either left or right hand operation.

Unlike an AR-15 rifle where the safety selector provides the direct physical restraint for the trigger, the present safety mechanism uses another separate component in the form of a safety shaft to interact directly with the trigger. The safety shaft, still operated by the safety selector, is located forward of the trigger in one embodiment to selectively engage or disengage the trigger; the trigger's movement being arrested when engaged to disable the trigger-actuated firing mechanism. The safety selector is mounted rearward of the trigger on the lateral side of the firearm in the same convenient position as used on an AR-15 rifle. However, the physically separated safety shaft and safety selector are mechanically coupled via a mechanical linkage such that rotating the selector concomitantly rotates and operates the shaft. A pistol grip may be provided which takes advantage of the side-mounted safety selector.

According to one aspect, a firearm with safety mechanism includes: a receiver; a barrel coupled to the receiver and defining a longitudinal axis; a trigger housing detachably coupled to the receiver; a trigger-actuated firing mechanism mounted in the trigger housing and operable to discharge the firearm via a trigger pull; a safety shaft extending transversely through the trigger housing and defining a first pivot axis, the safety shaft rotatable between a blocking position in which the safety shaft disables the firing mechanism and an unblocking position in which the shaft enables the firing mechanism to discharge the firearm; a safety selector comprising a control shaft extending transversely through the trigger housing and defining a second pivot axis, the safety selector mechanically coupled to the safety shaft such that rotation of the safety selector rotates the safety shaft, the safety selector rotatable between a safe position and a fire position; and a selector switch disposed on a first end of the control shaft for operating the safety selector. Rotating the safety selector about the second pivot in a first direction from the safe position to the fire position rotates the safety shaft about the first pivot axis from the blocking position to the unblocking position; and rotating the safety selector about the second pivot axis in a second direction from the fire position to the safe position rotates the safety shaft about the first pivot axis from the unblocking position to the blocking position.

According to another aspect, a trigger housing assembly attachable to a bolt-action firearm includes: a body defining an interior space and longitudinal axis; a firing mechanism disposed at least partially in the interior space, the firing mechanism operable to discharge the firearm via pulling a trigger movably mounted to the body; a safety shaft extending transversely through the trigger housing and defining a first pivot axis, the safety shaft rotatable between a blocking position in which the safety shaft disables the firing mechanism and an unblocking position in which the shaft enables the firing mechanism to discharge the firearm; a downwardly open vertical first slot formed in the body; a rotary cam rotatably disposed in the body proximate to the first slot, the rotary cam comprising a second slot having an open end and a closed end; the rotary cam rotatable between an aligned position in which the first and second slots are in vertical alignment and a misaligned position in which the second slot of the rotary cam is not in vertical alignment with the first slot of the body; a control rod coupling the rotary cam to the safety shaft; and a safety selector comprising a control shaft defining a second pivot axis and elongated selector switch extending radially outward from a first end of the control shaft for operating the safety selector, the control shaft inserted transversely through the first and second slots of the body and rotary cam respectively, the control forming a locking fit with the rotary cam such that rotating the safety selector concurrently rotates the rotary cam. Rotating the safety selector about the second pivot in a first direction from the safe position to the fire position concurrently rotates the safety shaft about the first pivot axis from the blocking position to the unblocking position; and rotating the safety selector about the second pivot axis in a second direction from the fire position to the safe position concurrently rotates the safety shaft about the first pivot axis from the unblocking position to the blocking position.

A method for operating a safety mechanism of a bolt-action rifle is provided. The method includes: providing a firearm including a longitudinal axis, a receiver, a barrel supported by the receiver, and a trigger housing comprising (1) a trigger-actuated firing mechanism operable to discharge the firearm, (2) a rotary safety selector including a control shaft extending transversely through the trigger housing and a selector switch, (3) a rotary safety shaft extending transversely through the trigger housing and including a blocking surface and an operating surface, and (4) a control rod operably coupling the safety selector to the safety shaft; rotating the safety selector in a first direction to a "safe" rotational position; concurrently rotating the safety shaft in a second rotational direction via the control shaft by rotating the safety selector in the first direction; engaging the blocking surface of the safety shaft with a trigger of the firing mechanism, wherein movement of the trigger is prevented to disable the firing mechanism; rotating the safety selector opposite to the first rotational direction to a "fire" rotational position; concurrently rotating the safety shaft opposite to the second rotational direction via the control shaft by rotating the safety selector opposite to the first rotational direction; disengaging the blocking surface of the safety shaft from the trigger of the firing mechanism; and aligning the operating surface of the safety shaft to the trigger providing clearance such that movement of the trigger is not prevented to enable the firing mechanism.

According to one aspect, a trigger housing mounting system for a firearm includes: a longitudinal axis defining an axial direction; a receiver defining a downwardly open mounting slot elongated in the axial direction; first and second receiver tabs disposed on opposite lateral sides of the mounting slot in the receiver; a trigger housing removably attached to the receiver, the trigger housing having a lower portion and an upper mounting portion comprising first and second trigger housing tabs disposed on opposite lateral sides of the trigger housing, the trigger housing tabs protruding transversely outwards from the mounting portion in opposite directions for engaging the receiver tabs; the upper mounting portion of the trigger housing vertically inserted through the mounting slot, the trigger housing axially slidable forward and rearward in the mounting slot between a locked position in which the trigger housing tabs engage the receiver tabs, and an unlocked position in which the trigger housing tabs disengage the receiver tabs; a spring-biased locking block movably disposed on the upper mounting portion of the trigger housing, the locking block movable between a lower non-blocking position and an upper blocking position; and a spring biasing the locking block towards the upper blocking position; wherein the trigger housing is slidable in the mounting slot when the locking block is in the non-blocking position, and the trigger housing is not slidable when the locking block is in the blocking position.

According to another aspect, a trigger housing mounting system for a firearm includes: a longitudinal axis defining an axial direction; a receiver having a body defining a downwardly open mounting slot elongated in the axial direction; opposing first and second cutouts disposed on opposite lateral sides of the mounting slot in the receiver, the first and second cutouts in communication with the mounting slot; a trigger housing removably attached to the receiver, the trigger housing having a lower portion and an upper mounting portion comprising opposing first and second mounting tabs protruding transversely outwards from the mounting portion in opposite directions for engaging the receiver; the first and second mounting tabs being insertable through the first and second cutouts and slidably received in receiver above the mounting slot; the trigger housing being axially slidable forward and rearward in the mounting slot between a locked position in which first and second mounting tabs are lockingly engaged with and not removable from the receiver, and an unlocked position in which the first and second mounting tabs are vertically aligned with first and second cutouts and removable from the receiver; a spring-biased locking block movably disposed on the upper mounting portion of the trigger housing, the locking block selectively insertable into and out of the mounting slot of the receiver; a spring biasing the locking block towards the receiver; the locking block vertically movable between a lower non-blocking position in which the locking block is inserted in the slot which permits sliding the trigger housing from the locked position to the unlocked position, and an upper blocking position which prevents sliding the trigger housing from the unlocked position to the locked position.

According to another aspect, a method for mounting a trigger housing to a receiver of a firearm includes: providing a receiver having a longitudinal axis defining an axial direction and a downwardly open mounting slot elongated in the axial direction; providing a trigger housing having a lower portion and an upper mounting portion comprising opposing mounting tabs protruding transversely outwards from the mounting portion in opposite directions for engaging the receiver, the trigger housing further including a spring-biased locking block disposed on the upper mounting portion of the trigger housing and vertically movable in upward and downward directions, the locking block biased upward by a spring mounted to the trigger housing; positioning the trigger housing below the mounting slot; vertically aligning the mounting tabs with the opposing cutouts disposed on opposite lateral sides of the mounting slot in the receiver; raising the trigger housing towards the receiver; inserting the mounting tabs upwards into the receiver through the cutouts, wherein the trigger housing is in an unlocked position; engaging the locking block with a bottom surface of the receiver adjacent to a rear end of the mounting slot, thereby compressing the spring; sliding the trigger housing forward through the mounting slot to a locked position; engaging the mounting tabs with the receiver which vertically aligns the locking block below the cutouts in the receiver; the spring expanding and projecting the locking block upward through the cutouts into the receiver and mounting slot, wherein the locking block is positioned to block rearward movement of the trigger housing to the unlocked position.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which:

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures. Furthermore, a general reference to a whole figure number (e.g. FIG. 6) which may include multiple subparts (e.g. FIGS. 6A, 6B, etc.) shall be construed as a reference to all of the subparts unless specifically noted otherwise.

DETAILED DESCRIPTION

Figure 1:
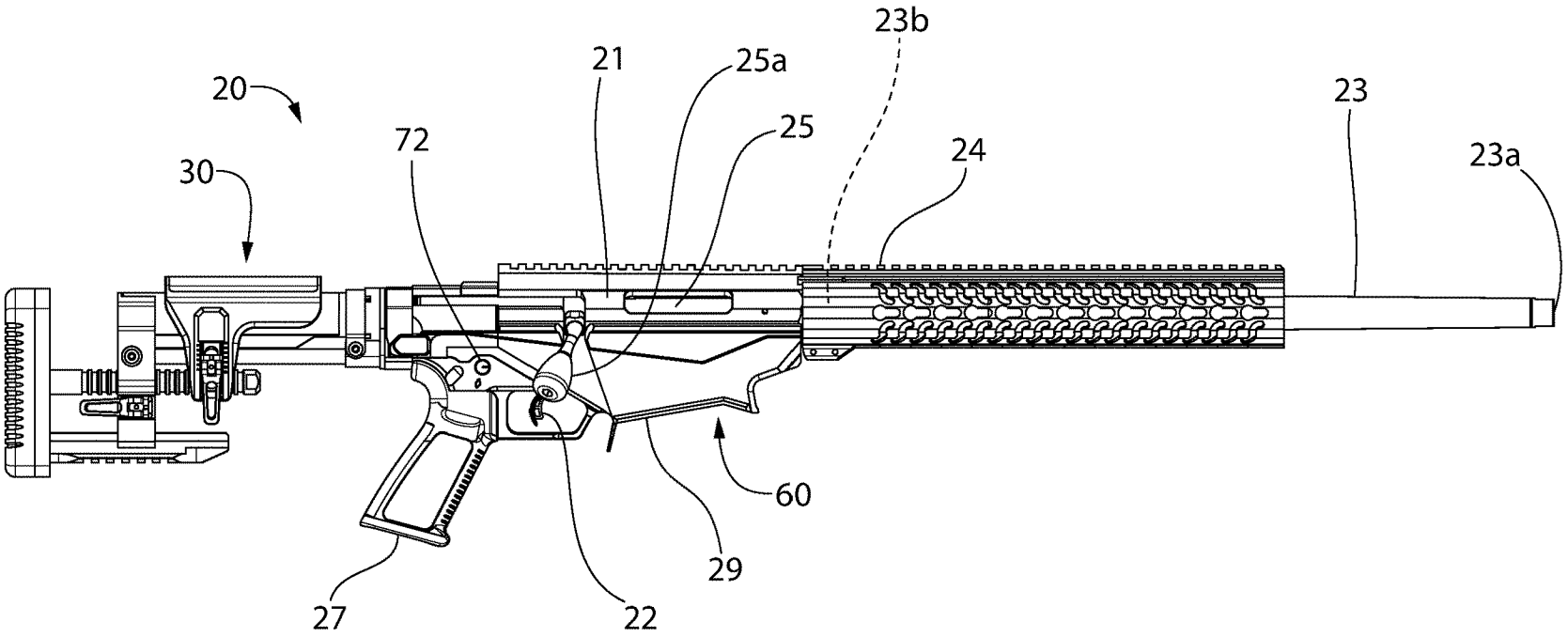
FIGS. 1 and 2 are right and left side views respectively of one embodiment of a firearm including a safety mechanism according to the present disclosure.

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

FIGS. 1-4 depict a firearm 20 with safety selector and interlock mechanisms according to the present disclosure. In one non-limiting example illustrated herein, the firearm 20 may be a bolt action rifle.

Figure 2:
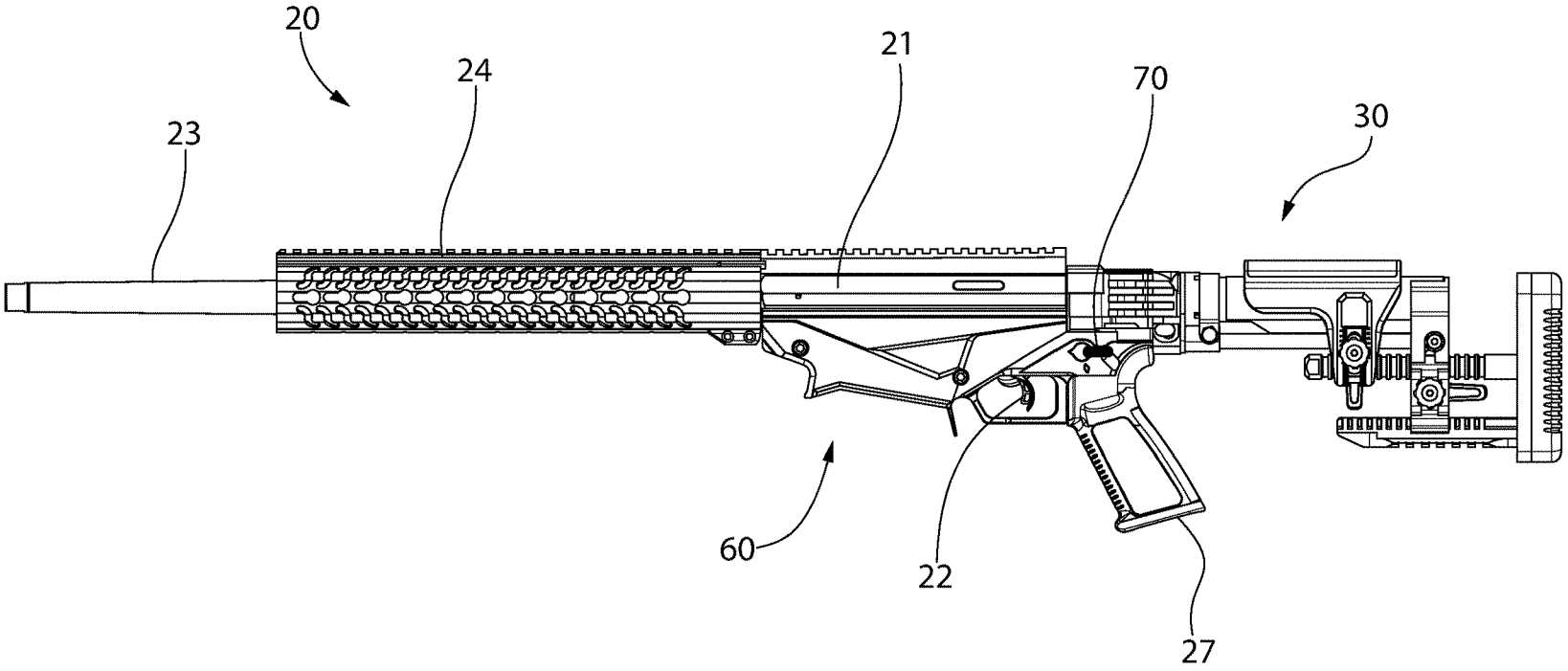
Figure 3:
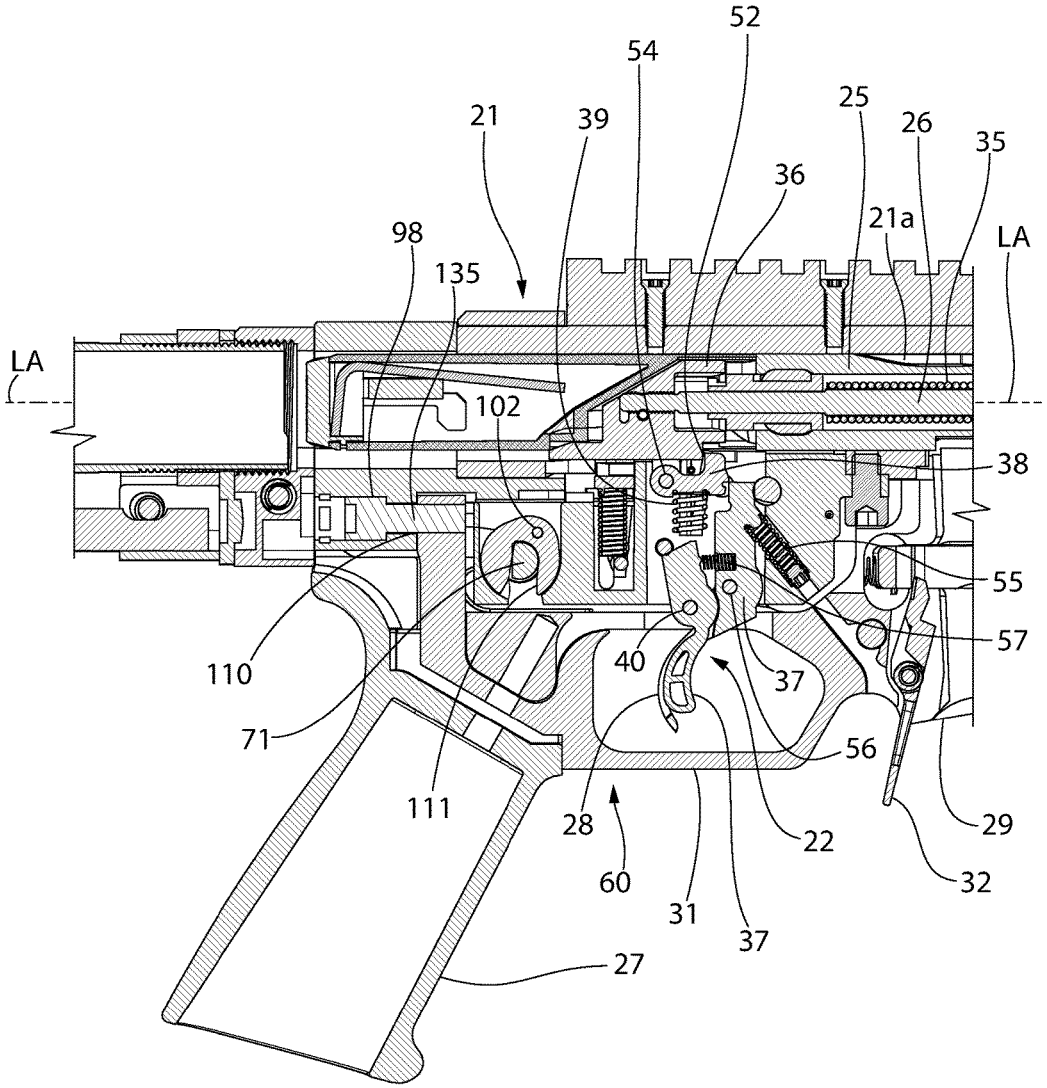
FIG. 3 is a partial right side view of the firearm showing the firing mechanism components.

Referring to FIGS. 1-3, firearm 20 generally includes a receiver 21, a trigger housing 22 detachably mounted to the receiver, a barrel 23 supported by the receiver, and optionally a handguard 24 enclosing and circumscribing at least part of the length of the barrel. Receiver 21 includes a front end 21*c* coupled to barrel 23 and an opposite rear end 21*b*. The barrel includes an open front muzzle end 23*a* and an open rear breech end 23*b* (obscured beneath the handguard) coupled to the front end of the receiver 21 in any suitable manner (e.g. threading, interlocking lugs, barrel or lock nut, etc.). The barrel of rifle 20 defines a longitudinal axis LA and axial direction of the firearm coinciding with the centerline of the barrel 23 and its longitudinal bore formed therein between the muzzle and breech ends 23*a*, 23*b* (not shown) that defines the projectile pathway. Handguard 24 if provided may be any type and coupled to the front end of the receiver and/or the barrel.

Firearm 20 further includes a buttstock 30 extending rearward from the receiver 21 for placement against the user's shoulder when aiming the firearm held in a ready-to-fire position to acquire a target. Buttstock 30 may be any type or configuration of buttstock including fixed, adjustable and non-adjustable types, and folding and non-folding types. The invention is not limited by the type of buttstock which may be used.

Firearm 20 further includes a lower assembly or stock 60, which in one non-limiting embodiment is detachably mounted to the bottom of the receiver 21. Lower stock 60 includes a front portion 33, opposing rear portion 34, trigger guard 31 position to enclose trigger 28, a pistol grip 27 rearward of the trigger guard, and magazine well 29 forward of the trigger guard. The magazine well is configured and structured to removably detain and latch an insertable box type ammunition magazine via pivotable latch 32 mounted to the lower stock 60 at the rear of the magazine well 29 (best shown in FIG. 3).

Figure 5:
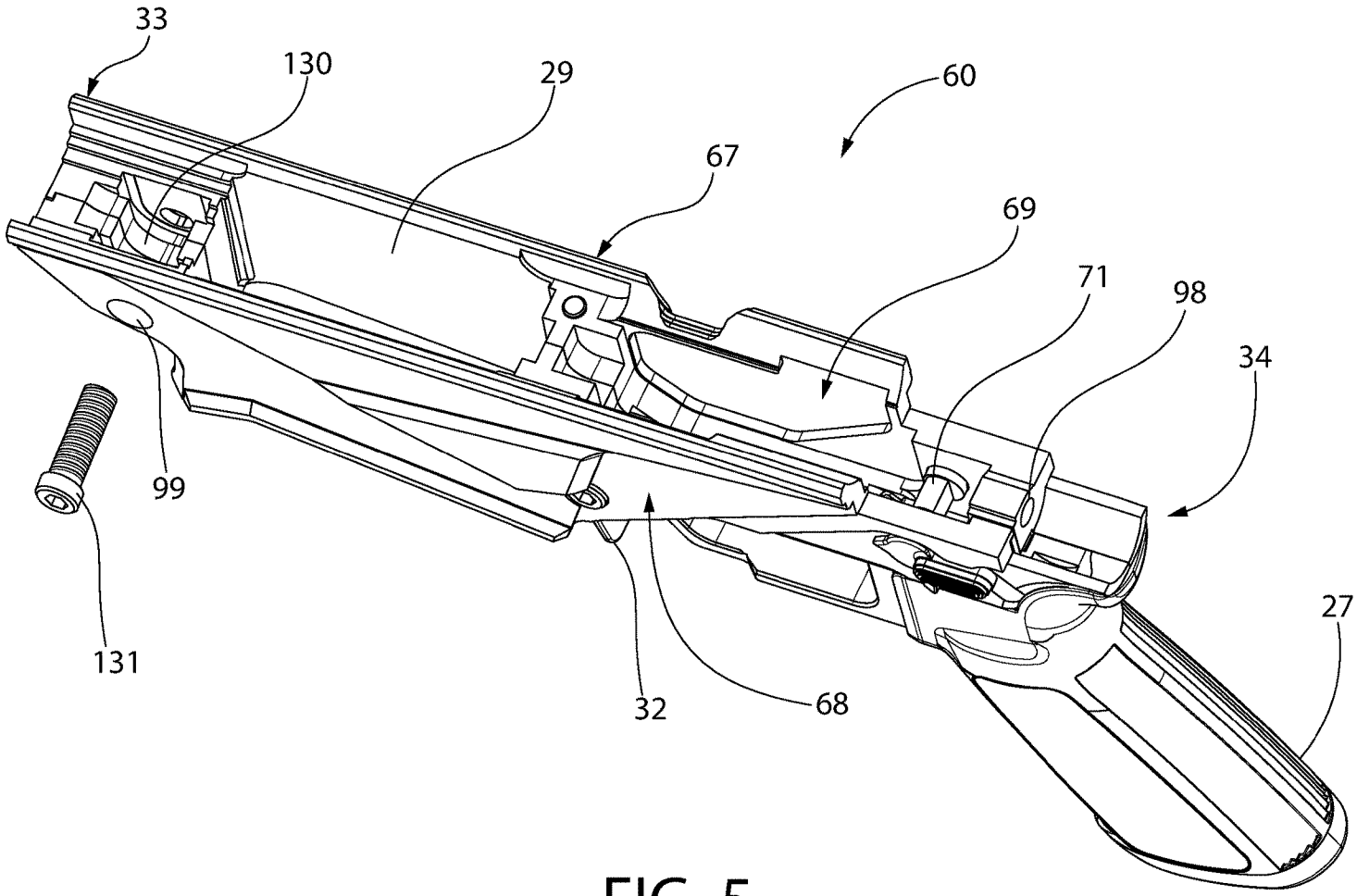
FIG. 5 is a top perspective view of a removable lower assembly or stock of the firearm of FIG. 1.
Figure 6:
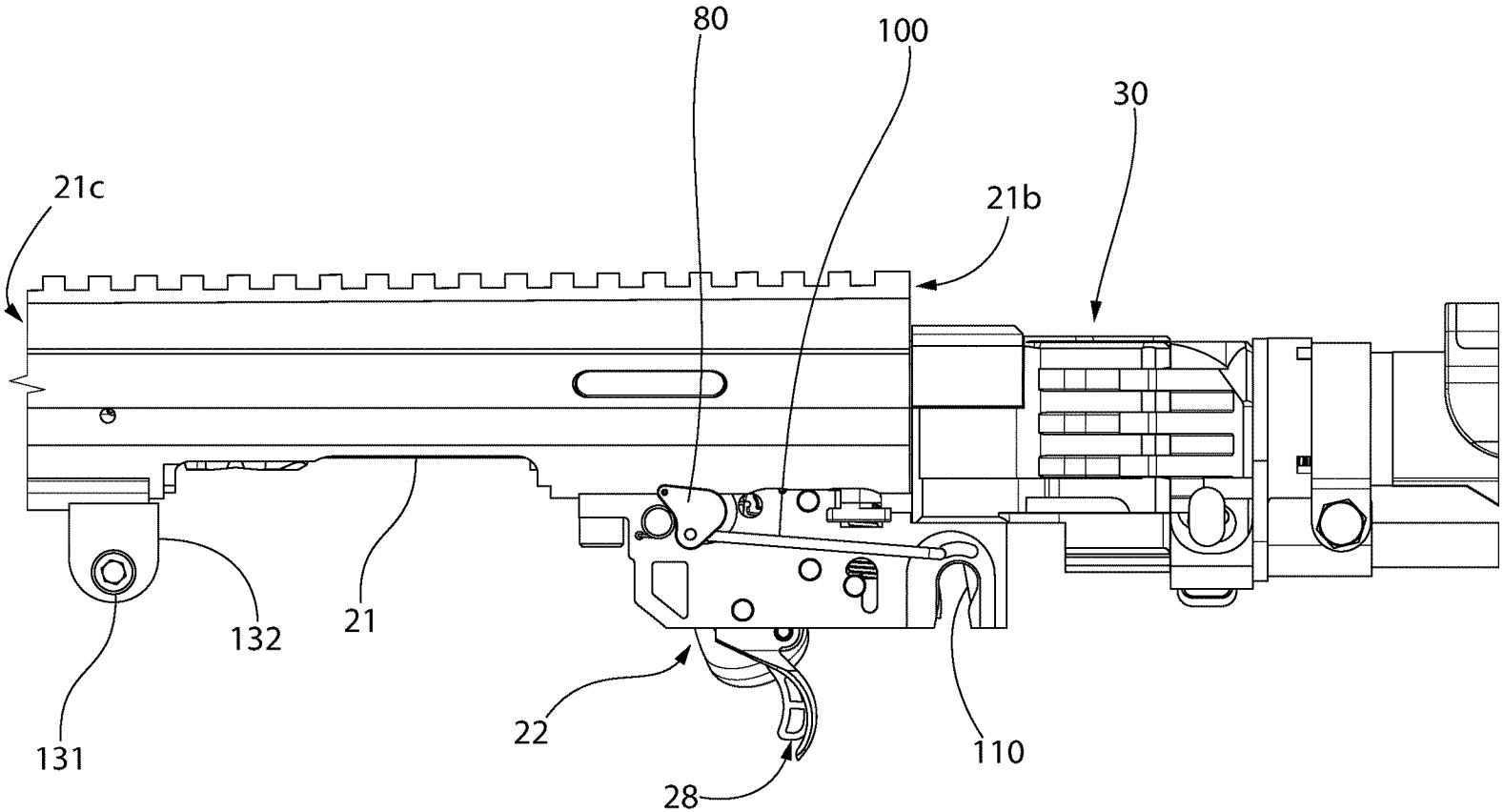
FIG. 6 is a partial left side view of the firearm with the lower stock removed.

In one non-limiting implementation, there are two mounting points which may be used to secure the lower stock 60 to the receiver 21. Referring to FIGS. 3, 5, and 6, a front mounting features includes an upwardly open locking recess 130 in lower stock 60 configured with a raised central rib. Recess 130 receives dual laterally spaced mounting lugs 132 projecting downwards from the front portion of receiver 21. One of the lugs 132 (far or right lug) has a threaded hole and one lug (near or left side) has a clearance hole. When the lower stock 60 is raised into place on the bottom of the receiver 21, the lugs 132 are positioned on opposite sides of the raised rib central which is received between the lugs. In one configuration, the bottom of the lugs 132 may be convexly rounded and the recess 130 on opposite sides of the central rib may be concavely round by arcuate walls of the lower stock formed at the bottom of the recess (best shown in FIG. 5). Once the upper is raised into place, a threaded bolt 131 is inserted through hole 99 in the left lateral side 68 of the lower stock 60, passing through the clearance hole in the near side lug and engaging the threaded hole in the far side lug. When tightened, the lugs 132 are pulled together to compress the central rib in recess 130 of the stock 60 thereby securely holding the stock laterally to the receiver while the bolt 131 also retains the lower stock vertically.

The second rear mounting feature can be seen in FIGS. 3 and 5. A socket head cap screw or other type threaded fastener 135 is inserted from the back of the firearm through the receiver 21 and lower stock 60. An axial threaded hole 98 formed in the rear of the lower stock receives the threaded fastener 135 extending through and from a concentrically aligned hole in the receiver which secures the rear end of the lower stock 60 to the receiver. Preferably, this fastener 135 should be secured first, which helps brings the lower into a more consistent position and alignment relative to the receiver 21 and trigger housing 22, and afterwards the front bolt 131 may next be tightened lastly. However, in other possible lower stock mounting sequences, the front bolt may be secured first before the rear bolt.

The fire control mechanism and safety will now be described.

The receiver 21 supports portions of the trigger-actuated fire control mechanism operable to discharge the firearm 20. The fire control mechanism includes an axially movable and elongated bolt 25 which may include a bolt handle 25*a* for manually operating the action to form a closed or open breech in relation to the chamber formed at the rear breech end 25*b* of barrel 25 which holds an ammunition cartridge. The bolt 25 is slidably moveable forward/rearward in an axially extending internal cavity 21*a* of receiver 21. The bolt assembly comprises a slidable striker or firing pin 26 carrier inside the bolt 25 for detonating a chambered cartridge when the firearm is discharged, a main spring 35 which acts to bias the firing pin rearward in a cocked ready-to-fire position, and a cocking piece 36 attached to the rear end of the firing pin (best shown in FIG. 3). The foregoing firing mechanism components are mounted in and supported by the receiver 21.

Figure 9:
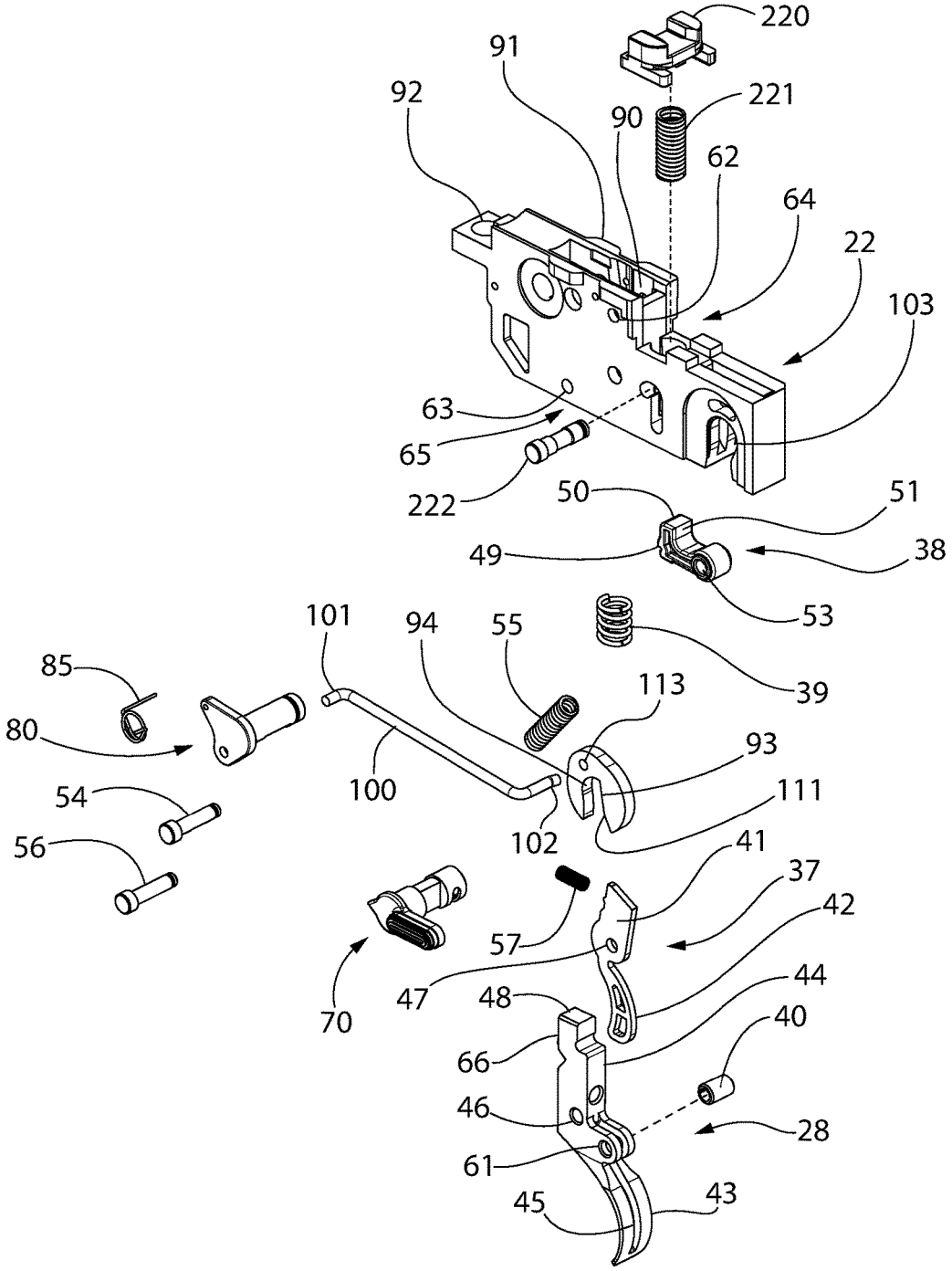
FIG. 9 is an exploded perspective view thereof.

The trigger housing 22 supports the other portions of the firing mechanism which operate together via pulling trigger 28 to release a cocked firing pin 26 for discharging the firearm. Referring to FIGS. 3 and 9, the trigger housing 22 has a generally rectangular elongated body defining an interior space 90 and various external openings to access the space for housing various firing mechanism components described herein. Trigger housing 22 may be removably attached to the receiver 21 by a variety of mechanical means. In one embodiment, the trigger housing may include a plurality of laterally extending tabs 91 which interlock with mating tabs formed in the underside of the receiver (not shown) to suspend the housing from beneath the receiver. One or more fastener openings 92 may be provided which receive fasteners therethrough to complete securement of the trigger housing 22 to the receiver 21. In other possible embodiments, fasteners alone may be used to secure the trigger housing to receiver. Other mechanical methods or combinations of methods may also be used. The invention is not limited by the type of means used to detachably secure the trigger housing to the receiver. Preferably, the trigger housing 22 is securely attached to the receiver 21 of the firearm to ensure that the relationship between the sear 38 and the firing pin cocking piece 36 used to hold or release the firing pin 26 is maintained to prevent variable trigger feel and uncontrolled disengagement. The trigger housing 22 cannot be removed without first removing the lower stock 60 assembly from the firearm.

The firing mechanism components supported by the trigger housing 22 includes a dual trigger mechanism including trigger 28 and trigger release member 37 which cooperates with the trigger to release a sear 38. Trigger 28 is movably mounted to trigger housing 22. In one non-limiting embodiment as illustrated, the trigger is pivotably mounted to the module about transverse pin 56 which defines a pivot axis of the trigger. The trigger release member 37 is pivotably mounted to the trigger 28 about a second transverse pin 40 which is disposed just rearward of the trigger pin 56. This defines a separate pivot axis for the release member which is parallel to the trigger's pivot axis. Both the trigger 28 and the trigger release member 37 pivot in forward and rearward axial directions parallel to the longitudinal axis LA, as further described herein.

Trigger 28 has a vertically elongated body including a lower arcuately curved operating end 43 for engaging a user's trigger finger and a vertically elongated upper sear catch protrusion 44 protruding upwards from the operating end. Lateral mounting hole 46 receives transverse pin 56 to pivotably mount the trigger to the trigger housing 22. Sear catch protrusion 44 includes an upward facing ledge 48 configured and arranged to selectively engage a mating downward facing hook-shaped sear catch 49 formed on the sear 38 for holding the sear in an upright position until the firearm 20 is discharged.

The trigger release member 37 has a vertically elongated flat or plate-like body defining an arcuately curved lower operating end 42 shaped for engaging a user's trigger finger and upper extension 41 protruding upwardly from the operating end. Lateral mounting hole 47 in the release member and mounting hole 61 in the trigger 28 receive transverse pin 40 to pivotably mount the release member to the trigger 28. The release member 37 is therefore supported by and movable in relation to the trigger. The operating end 42 of release member 37 is slideably received through a vertical slot 45 in curved operating end 43 of the trigger 28.

Sear 38 has a horizontally elongated body including catch 49 formed on the front side or face, and an upwardly extending and vertically elongated firing pin catch protrusion 50. Lateral mounting hole 53 receives transverse pin 54 to pivotably mount the sear 38 to the trigger housing 22. Firing pin catch protrusion 50 defines a rear facing blocking surface 51 which is configured and arranged to abuttingly engage a mating front facing stop surface 52 formed on the cocking piece 36 of the bolt assembly (see, e.g. FIG. 3). Sear spring 39 biases the sear 38 into an upwards blocking position about pin 54 to force and positively maintain blocking surface 51 against stop surface 52 to prevent the release of the firing pin absent a trigger pull. In one embodiment, spring 39 may be a helical compression spring; however, other types of springs (e.g. torsion) may be used.

Trigger 28 in turn is biased into an upwards position about pin 56 by trigger spring 55. In one embodiment, spring 55 may be a helical compression spring; however, other types of springs (e.g. torsion) may be used. Spring 55 acts on the vertical front side or surface 66 of the sear catch protrusion 44 of trigger 28 at a point above pin 56. This biases the trigger rearwards towards sear 38 which is mounted behind the sear catch protrusion 44 in the trigger housing 22. This in turn also forces the ledge 48 into positive engagement with the sear catch 49 on sear 38 for holding the sear in the upwards blocking position with a cocked firing pin 26. Spring 55 may be obliquely arranged to the longitudinal axis LA of firearm 20 to provide a line of action (extending along the axial centerline of the spring between its ends) which intersects the sear. This provides positive engagement of the ledge 48 on the trigger sear catch protrusion 44 with the sear catch 49. The sear catch protrusion 44 of trigger 28 is pivotable forwards about pin 56 to disengage and release the firing pin 26, as further described herein.

A spring 57 is disposed between and has opposing ends which act against both the trigger 28 and trigger release member 37, as seen in FIG. 3. The spring 57 is located above transverse pins 40 and 56 to bias the upper portions of the trigger and trigger release member apart. This in turn biases the curved lower operating end 42 of the trigger release member 37 to protrude forward beyond the curved lower operating end 43 of trigger 28 to maintain the release member. It bears noting that spring 57 is typically smaller in size than and has a lower spring force than trigger spring 55 so that the rearward spring force of spring 55 dominates and maintains positive engagement between the sear catch protrusion 44 and firing pin 26.

The firearm 20 may be discharged in the following manner. Referring to FIG. 3, the firing mechanism is shown in a ready-to-fire position. With addition reference to FIG. 9, the bolt 25 is forward in a closed breech position in battery with the barrel 23 wherein a cartridge is chambered in the breech end 23*b*. Firing pin 26 is held rearward in a cocked position by sear 38 via engagement between blocking and stop surfaces 51, 52 of the sear and cocking piece 36 of the bolt respectively. The sear 38 is in the upwards blocking position being held there by the trigger release member 37 which similarly is in its upwards blocking position by spring 55. Trigger 28 is in a substantially vertical non-pulled position.

Figure 7:
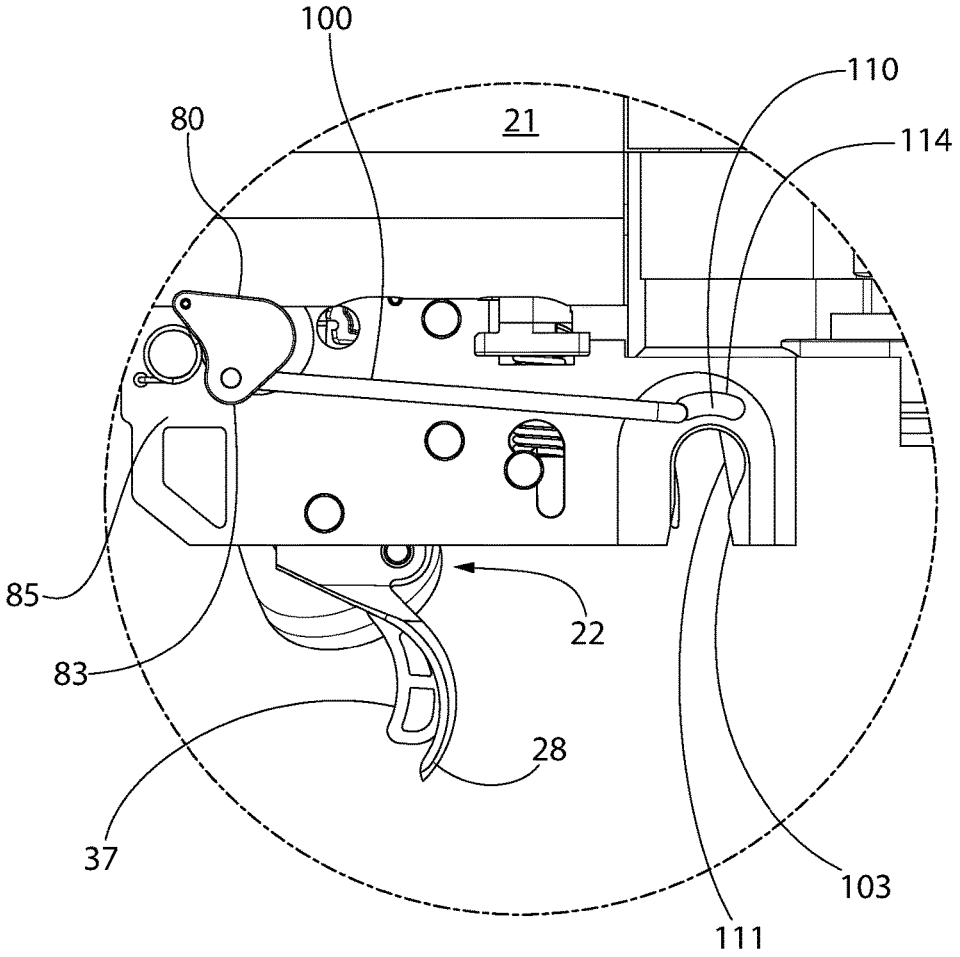
FIG. 7 is a detailed view taken from FIG. 6.

To discharge the firearm, a user first pulls the exposed portions of the trigger 28 (via lower operating end 43) and trigger release member 37 (via lower operating end 42) rearward. It should be noted that the user initially engages the lower operating end 42 of the trigger release member 37 which protrudes forward of the trigger 28 in the normal un-pulled position (see, e.g. FIGS. 3, 7, and 8). The trigger release member moves rearward compressing spring 57 against the sear catch protrusion 44 which remains stationary at this stage until the front of operating end 42 of the trigger release member 37 is flush with the front of the operating end 43 of the trigger 28. It bears noting that trigger block pin 132 (see, e.g. FIG. 10B) blocks the trigger movement until the trigger release is moved.

Continued pulling of both the trigger 28 and trigger release member 37 rearward together (counter-clockwise in FIG. 3) now rotates the upper extension 41 and sear catch protrusion 44 of the trigger release member and trigger respectively forward (clockwise in FIG. 3) against the rearward biasing force of spring 55. The ledge 48 on the trigger sear catch protrusion 44 disengages the sear catch 49 on sear 38. The sear 38 rotates downwards (clockwise in FIG. 3) to disengage the sear blocking surface 51 from the firing pin stop surface 52 on the cocking piece 36. The firing pin 26 is thus released and moves forward assisted by main spring 35 to strike its forward end against and detonate the chambered cartridge which is detonates to discharge the firearm.

According to one aspect of the invention, a mechanical safety mechanism is provided which acts to selectively arrest and disable the foregoing firing mechanism. This is intended to prevent inadvertent discharge of the firearm even if a trigger pull is attempted while the safety is "on." Advantageously, the present safety mechanism provides for a bolt action rifle the convenience of a side-mounted AR-15 style safety selector with pistol grip both traditionally found only on conventional AR-15 semi-automatic action type rifles.

Referring to FIGS. 6-11 inclusively, a safety mechanism in one embodiment generally comprises a safety shaft 80, a safety selector 70, and a safety operating linkage such as control rod 100 operably coupling the shaft and selector together. The control rod operates and controls the position of the safety shaft 80 via rotating the safety selector 70, as further described herein. Both the safety shaft and safety selector are mounted to the trigger housing 22.

The control rod 100 may be a wire-form linkage to allow actuation of the safety shaft 80 from a different location or even a different amount of rotation. The safety shaft 80 in the illustrated embodiment is disposed forward of trigger 28 and the safety selector 70 is disposed rearward of the trigger in the trigger housing. This linkage system allows the safety selector position to be less critical because it is not directly contacting the trigger to arrest its movement. This is important because when the safety selector is connected to a different component than the trigger housing, very tight tolerances would be required to maintain a close relative position.

The safety shaft 80 extends transversely through the trigger housing 22 between right and left opposing lateral sides 64, 65 of the housing and defines a pivot axis. With additional reference to FIGS. 21-29 showing details of the safety shaft 80, the shaft has a generally cylindrical shape and includes opposing ends 81, 82. A diametrically enlarged operating protrusion 83 extends radially from a first end 81 of the safety shaft in a direction perpendicular to the length of the shaft for coupling to the control rod 100. In one embodiment, protrusion 83 may have an oblong or lobed shape as illustrated. An aperture 84 is formed in protrusion 83 which receives a first hook-shaped curved end 101 of control rod 100 (see also FIGS. 8 and 9). Because aperture 84 is disposed radially distant and apart from the safety shaft 80, this arrangement provides added leverage to easily rotate the shaft using rod 100 against the biasing force spring 85. Spring 85 may be a torsion spring in one embodiment and biases the safety shaft 80 into two rotational positions shown in FIGS. 10A and 11A. One end of spring 85 engages the trigger housing as shown and the other end engages hole 133 formed in protrusion 83 (see, e.g. FIG. 21). Spring 85 helps stabilize rotational motion of the safety shaft. Other types of springs may be used in other embodiments.

The safety shaft 80 is rotatable between a blocking position in which the safety shaft disables the firing mechanism and an unblocking position in which the shaft enables the firing mechanism to discharge the firearm. Safety shaft 80 comprises a substantially flat operating surface 86 and a circumferentially adjoining arcuate blocking surface 87 formed by full diameter portions of the shaft on either side of the flat. The flat operating surface 86 is rotatable in radial position with the safety shaft. The term "substantially flat" indicates that although the operating surface 86 may be considered flat with respect to the arcuate blocking surface 87, the operating surface may in fact have a compound shape with portions of the surface 86 varying slightly in angularity to other portions of the surface 86 such as by 10 degrees or less; however, the overall profile of the operating surface may still be considered flat. The "flatness" of the surface will be dictated in part by configuration of the trigger 28 as explained below.

To enable the firing mechanism, the flat operating surface 86 is rotatable to a position arranged approximately parallel to a front surface 66 of the trigger 28 when the safety shaft is in the unblocking position. This provides a horizontal gap or clearance between the front surface 66 and flat operating surface 86 which allows pivotable movement of the trigger 28 sufficient to release the sear 38 and discharge the firearm by disengaging the cocking piece 36 of the firing pin 26. This corresponds to the rotational "fire" position of the safety selector 70.

To disable the firing mechanism, the safety shaft 80 is rotated to engage the arcuate blocking surface 87 with the front surface 66 of the trigger 28 when the safety shaft is in the blocking position. This prevents pivotable movement of the trigger sufficient to release the sear 38 and discharge the firearm. Movement of the trigger-actuated firing mechanism to discharge the firearm is therefore arrested. This corresponds to the rotational "safe" position of the safety selector 70.

The safety selector 70 will now be further described. With additional reference now to FIGS. 12-20 showing details of the safety selector 70, the safety selector comprises a cylindrical control shaft 71 which extends transversely through the trigger housing 22 between the right and left opposing lateral sides 64, 65 of the housing when positioned therein. The control shaft 71 defines opposing ends 72 and 73, and a pivot axis of the safety selector 70. In one embodiment, the pivot axis of the safety selector 70 is located lower in trigger housing 22 than the pivot axis of the safety shaft 80. An elongated selector switch 74 is disposed on a first end 73 of the shaft for operating the safety selector via a user's finger or thumb. The selector switch 74 extends radially in a direction perpendicular to the length of the control shaft 71 and may have any suitable shape and a surface texture selected to facilitate grasping by a user in some embodiments (e.g. ridges, knurling, etc.).

In one embodiment, the selector switch 74 may further comprise a firing mode indicator 79 adjoining end 73 of the control shaft 71. The indicator 79 may be circular in one embodiment and have a diameter the same as, or in a preferred embodiment larger than the diameter of the adjoining control shaft. An arrow 75 may be formed on the firing mode indicator 79 which is rotatable to point to indicia comprising for example "safe" and "fire" which optionally may be engraved in or otherwise marked on the lower stock 60 (e.g. lateral side 68) adjacent to the indicator. Other firing modes and indicia may be provided.

In one embodiment, the safety selector 70 is mounted in the lower stock 60 and supported independently of the trigger housing 22 such that removal of the lower stock from the firearm 20 and receiver 21 removes the safety selector with the lower stock without removing the safety selector from the lower stock or disassembling the safety or firing mechanism components. FIG. 5 shows this arrangement in the lower stock 60 with the control shaft 71 extending transversely and being received through apertures in opposing lateral right and left sides 67, 68 of the stock. In one embodiment, the end 72 of the control shaft 71 opposite the selector switch 74 penetrates lateral side 67 of the lower stock 60 and is exposed for viewing by the user. End 72 may be provided with firing mode indicia 77 (e.g. line, shape, etc.) which aligns with markings/indicia (e.g. "safe" and "fire") emplaced on the right lateral side 67 of the lower stock 60 to signal whether the safety selector 70 is in one of the two operating positions. Other firing modes and indicia may be provided.

It should be noted that the lateral sides 67, 68 of the lower stock 60 are spaced apart defining an axially elongated internal cavity 69 which is upwardly open to receive the trigger housing 22 therein when the lower stock is attached to the receiver 21.

According to another aspect, another benefit of the present design described here is that the safety selector 70 is held in place by the trigger housing, and not with a spring and plunger like the selector in an AR-15 rifle. Not only does this eliminate parts, but it makes it possible to reverse a standard AR-15 selector to provide the same function with the safety lever on either the left or right side. Eliminating the drag from the spring loaded plunger also allows the safety to rotate more smoothly and reduce the likely hood of the selector coming to rest in a partially engaged or disengaged position.

Figure 12:
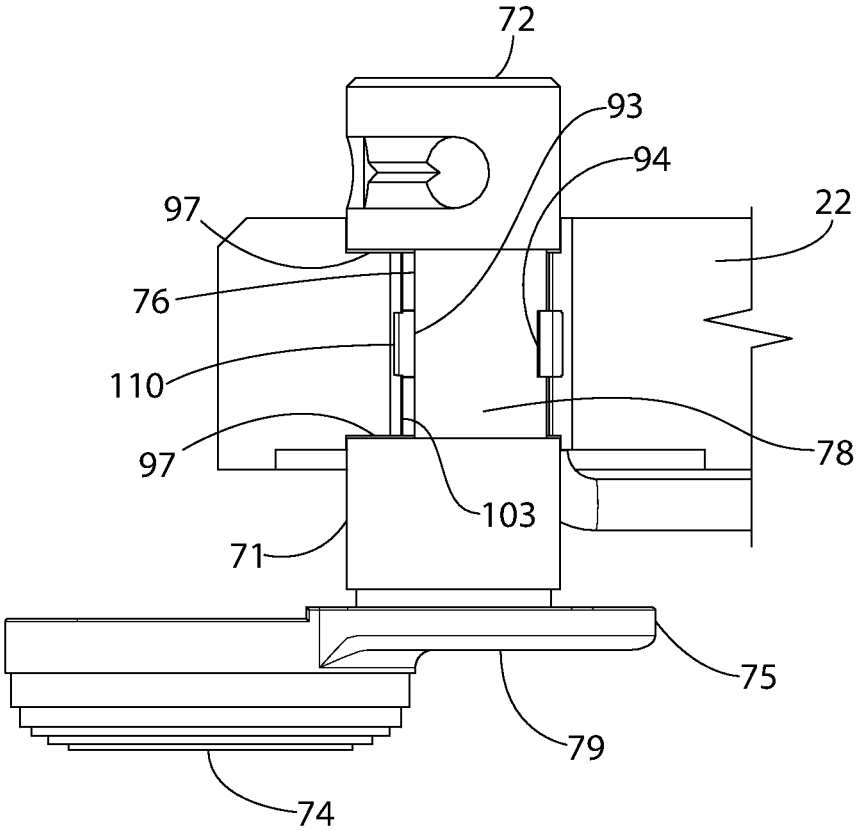
FIG. 12 is a bottom plan view of the trigger housing showing the safety selector mounted therein.
Figure 13:
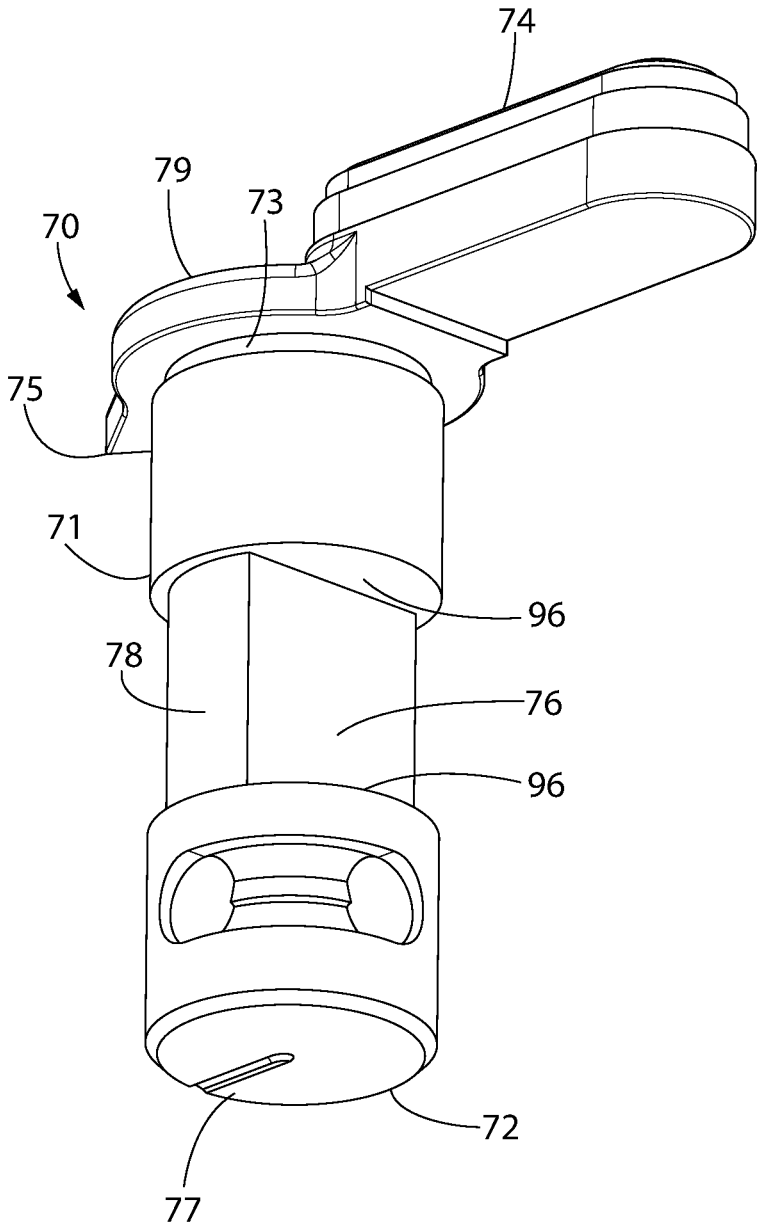
FIG. 13 is a perspective view of the safety selector.
Figure 14:
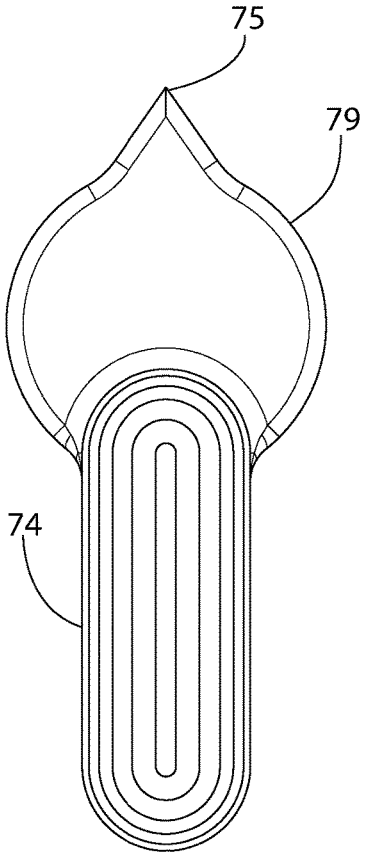
FIGS. 14 and 15 are left and right side views thereof.
Figure 15:
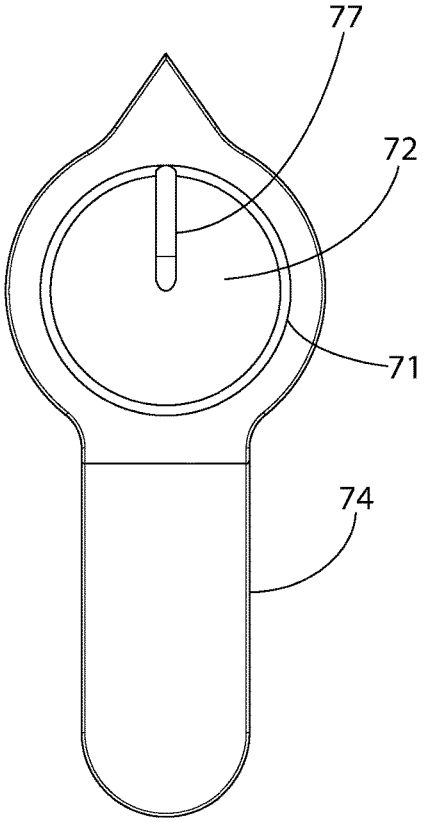
Figure 16:
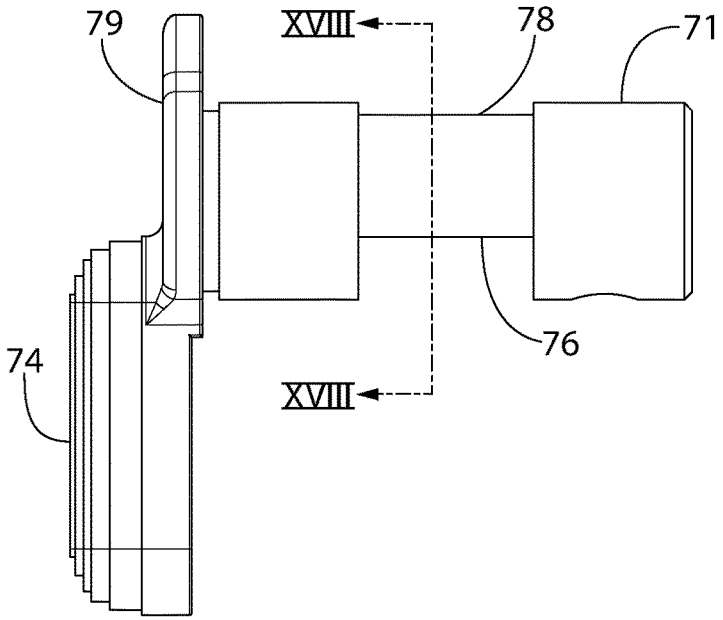
FIGS. 16 and 17 are top and bottom plan views thereof.
Figure 17:
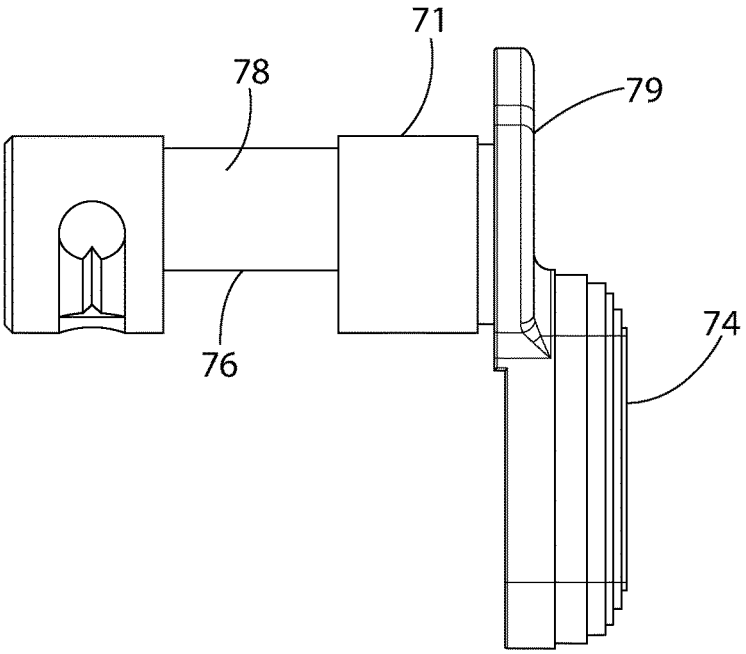

FIGS. 12 and 13 are referenced now to describe this interface between the safety selector 70 and trigger housing 22. The control shaft 71 of the safety selector 70 may have a stepped configuration defining a reduced diameter central portion formed by spaced apart shoulders on shaft. A pair of inward facing and opposing abutment surfaces 96 is formed by the stepped shaft 71. Abutment surfaces 96 abuttingly engages mating outward facing abutment surfaces 97 formed on each side of the vertical slot 103 in the housing. In this arrangement, the safety selector control shaft 71 can only be downwardly withdrawn from the slot 103 in the trigger housing 22, and not laterally removed therefrom.

Once the lower stock 60 is separated from the receiver 21, the safety selector 70 can be removed from the lower stock just be sliding it laterally outwards. While installed on the receiver 21, however, the trigger housing 22 prevents the selector from sliding laterally out of the stock or trigger housing. If an ambidextrous style selector is used, with a lever or switch 74 on each side which may be provided in some implementations, it would first have to be disassembled for removal from the lower assembly.

Figure 18:
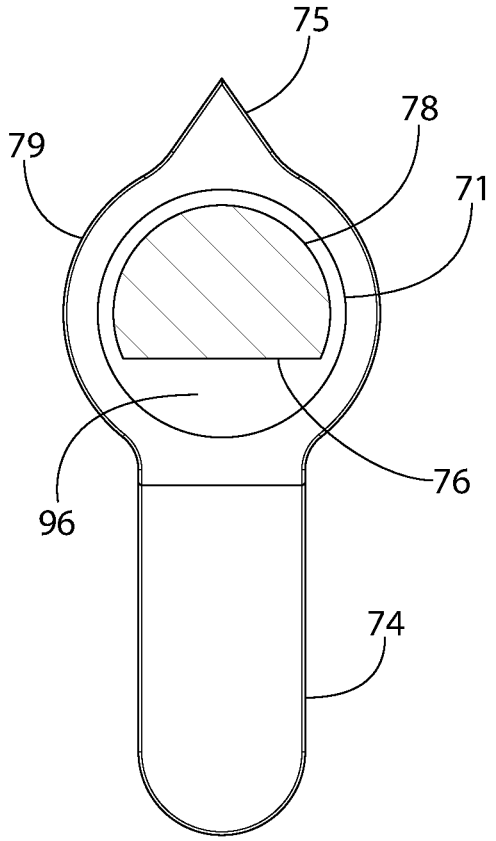
FIG. 18 is a transverse cross-sectional view thereof.
Figure 19:
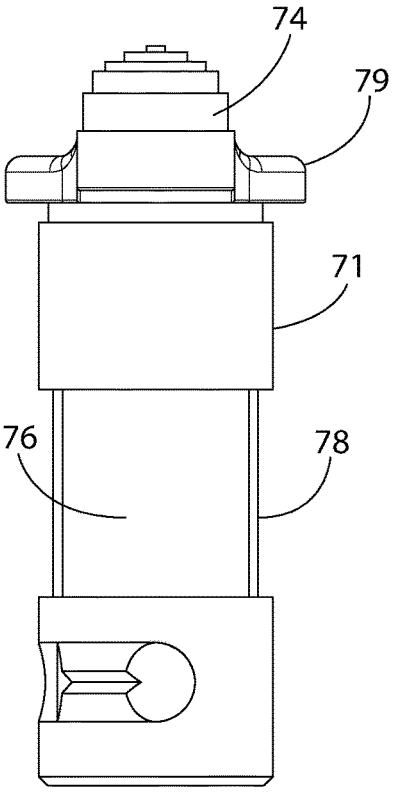
FIGS. 19 and 20 are rear and front views thereof.
Figure 20:
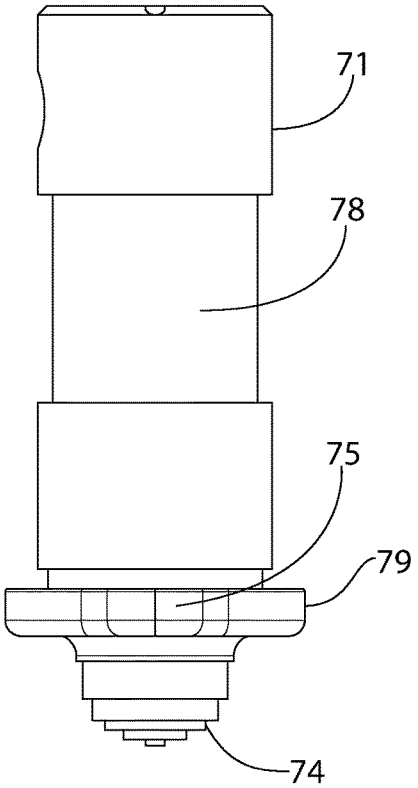
Figure 21:
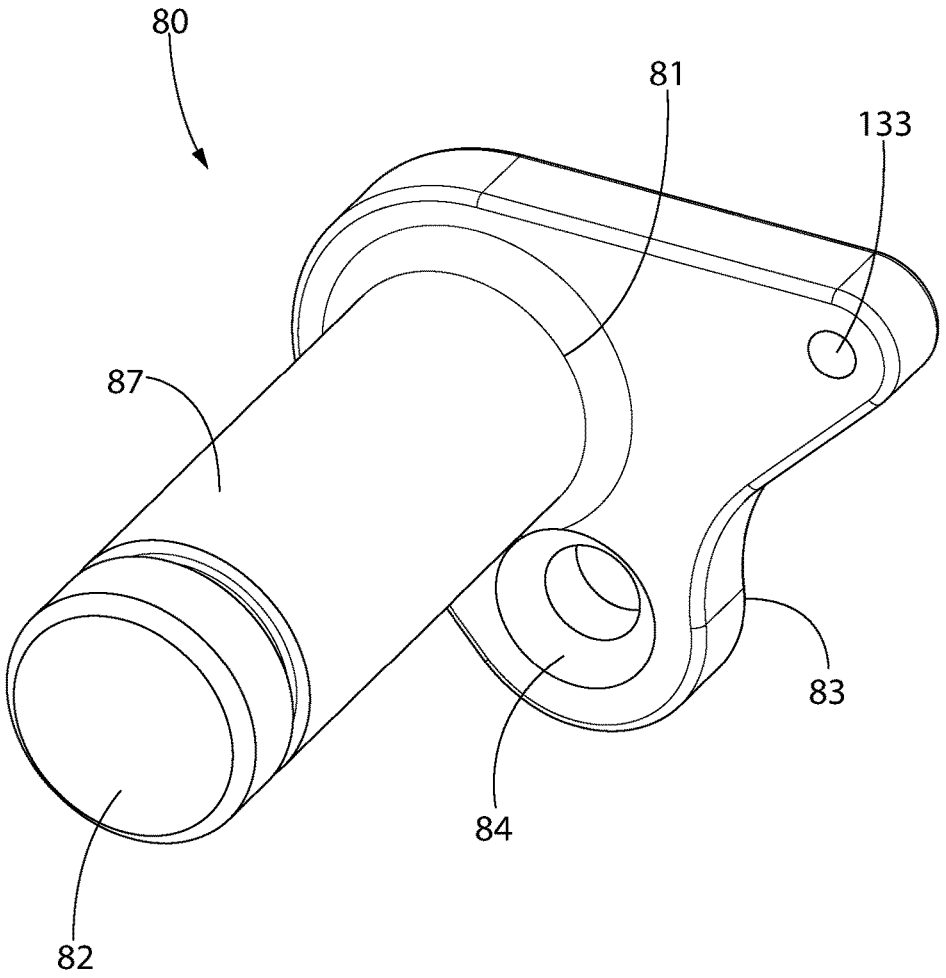
FIG. 21 is a right perspective view of the safety shaft.
Figure 22:
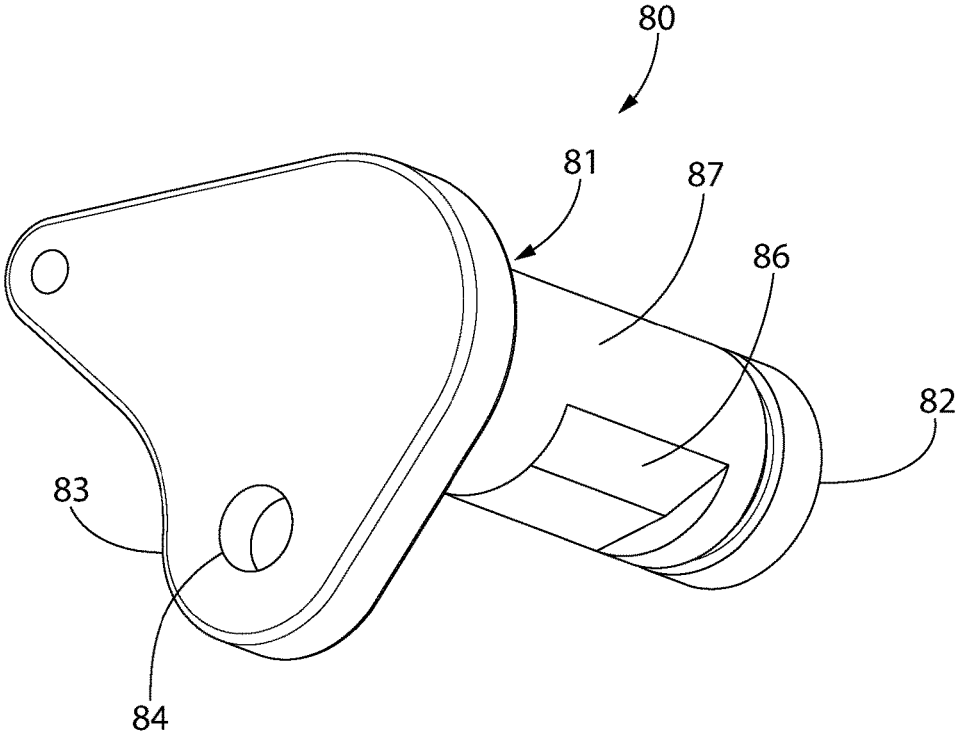
FIG. 22 is a left perspective view thereof.
Figure 23:
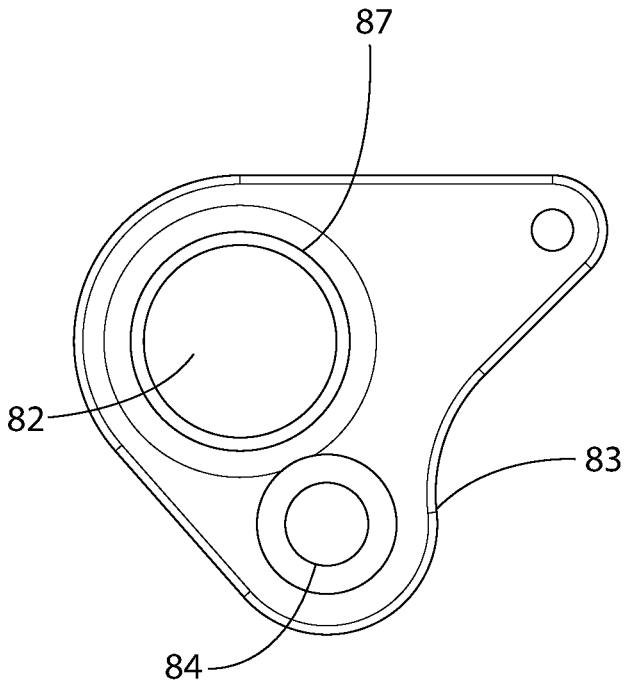
FIGS. 23 and 24 are right and left side views thereof.
Figure 24:
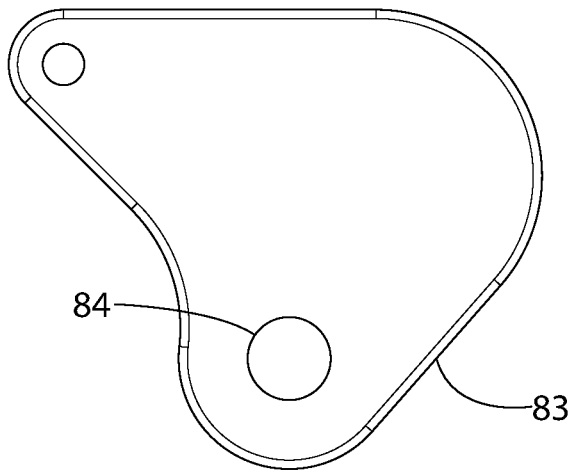
Figure 25:
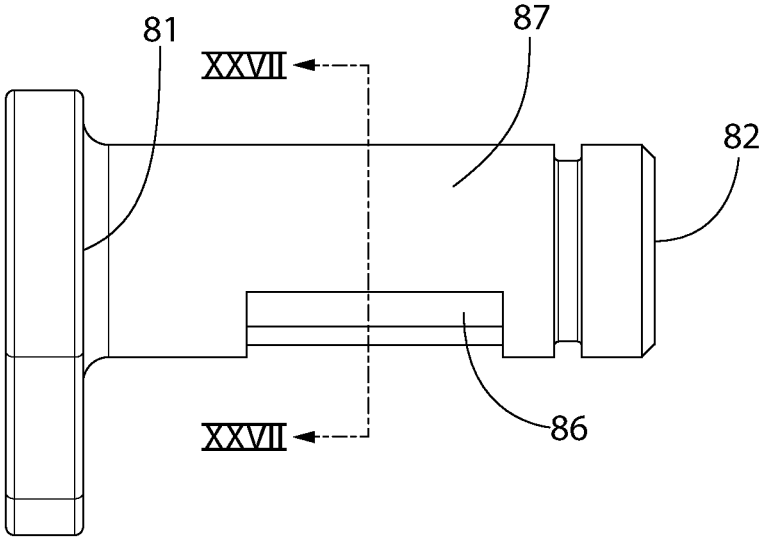
FIGS. 25 and 26 are rear and front views thereof.
Figure 26:
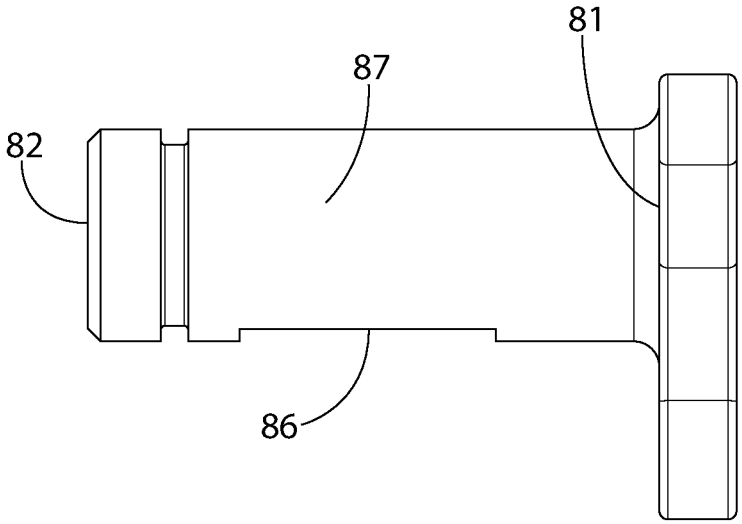
Figure 27:
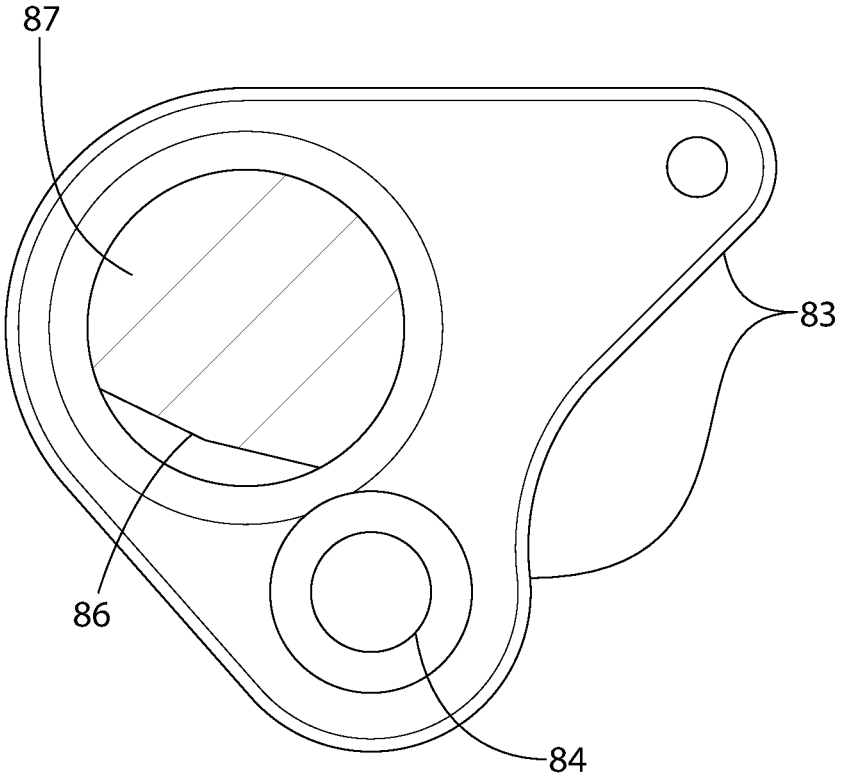
FIG. 27 is a transverse cross-sectional view thereof.
Figure 28:
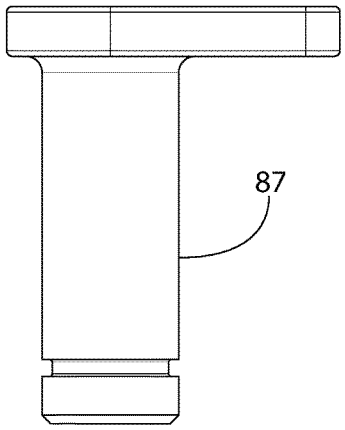
FIGS. 28 and 29 are top and bottom plan views thereof.
Figure 29:
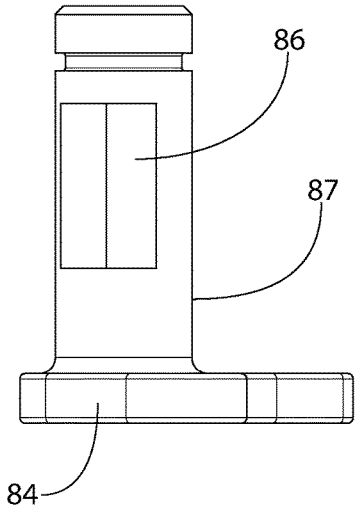
Figure 30:
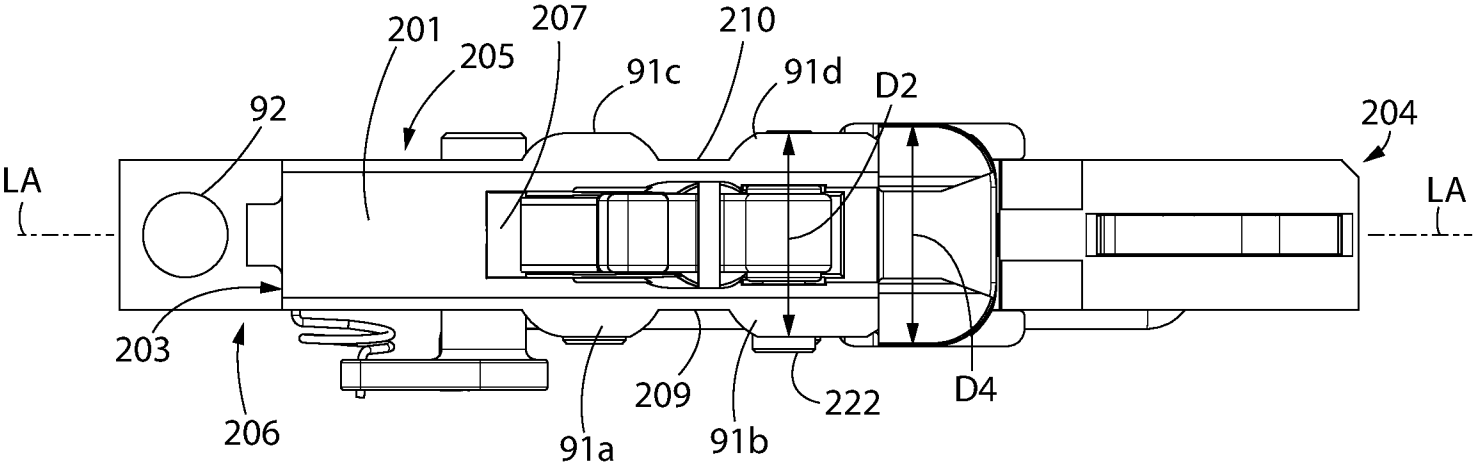
FIG. 30 is a top plan view of the trigger housing.

With reference now to FIGS. 12-20, the control shaft 71 of the safety selector 70 further comprises a flat surface 76 and a circumferentially adjoining arcuate surface 78 formed on either side of the flat in the reduced diameter central portion of the shaft. The flat surface 76 is rotatable in position with rotation of the safety selector control shaft 71 via the selector switch 74. In one embodiment, the portion of the control shaft 71 including the flat surface 76 may have a generally semi-circular shape in transverse cross section, as illustrated in FIG. 18. This shape lockingly mates with a complementary configured downwardly open vertical slot 111 formed in a rotary cam 110.

Referring to FIGS. 3 and 8-12, rotary cam 110 cooperates with the safety selector 70 and control rod 100 to impart rotational movement to the safety shaft 80 which is inaccessible to a user when the lower stock 60 is attached to the receiver 21. The rotary cam operates to convert rotary motion of the selector switch 74 and control shaft 71 coupled thereto into substantially linear axial motion of the control rod 100 which moves the safety shaft 80 between the blocking and unblocking positions by rotating the safety selector 70. Advantageously, this permits placement of the safety selector 70 rear of the trigger 28 on the left lateral side 68 of the lower stock for convenient use with pistol grip 27 formed on the lower stock.

Figure 8:
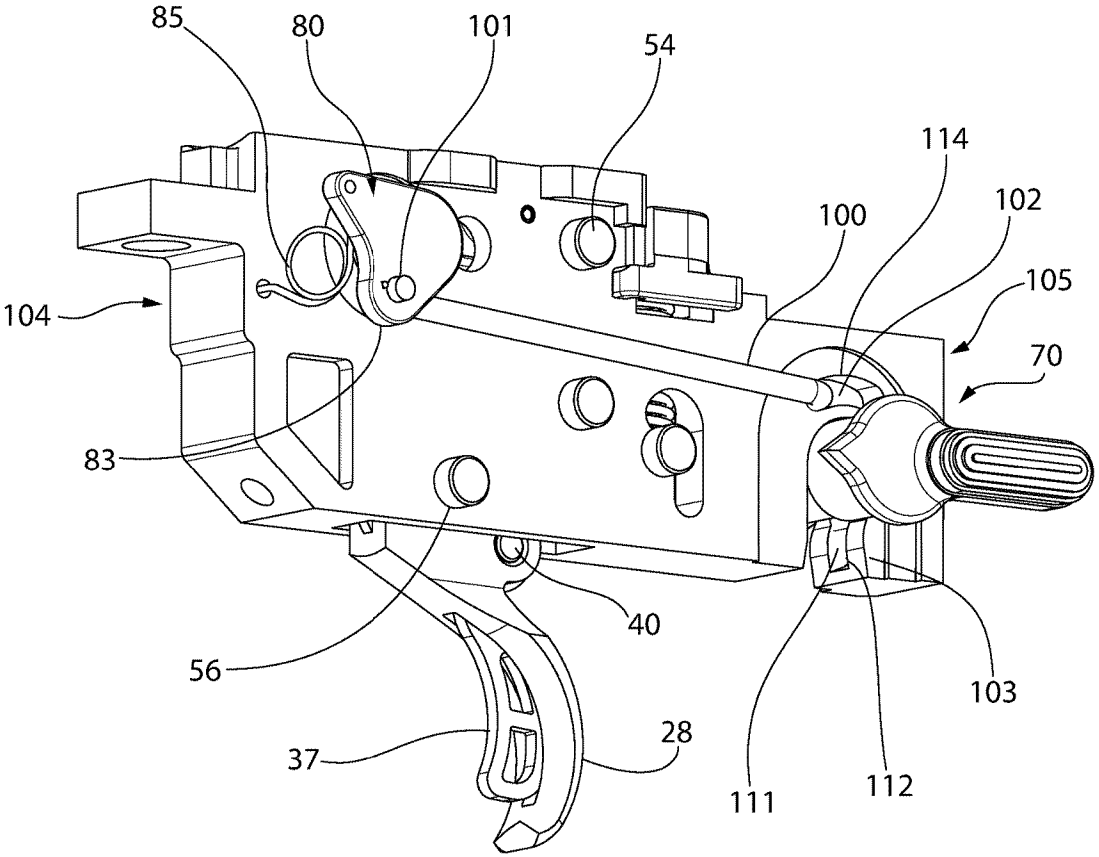
FIG. 8 is left perspective view of a removable trigger housing which houses the trigger actuated firing mechanism components.
Figure 10A:
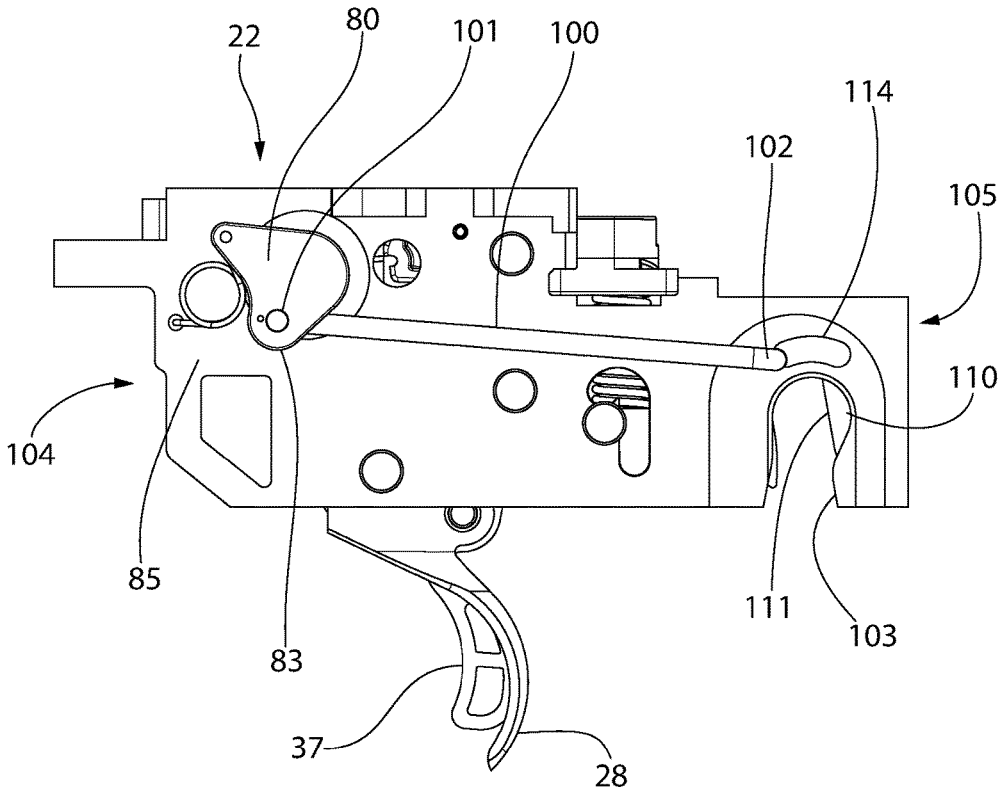
FIG. 10A is a left side view thereof associated with the safety selector in a "safe" firing mode position and the safety shaft engaging and preventing movement of the trigger to disable the firing mechanism.
Figure 10B:
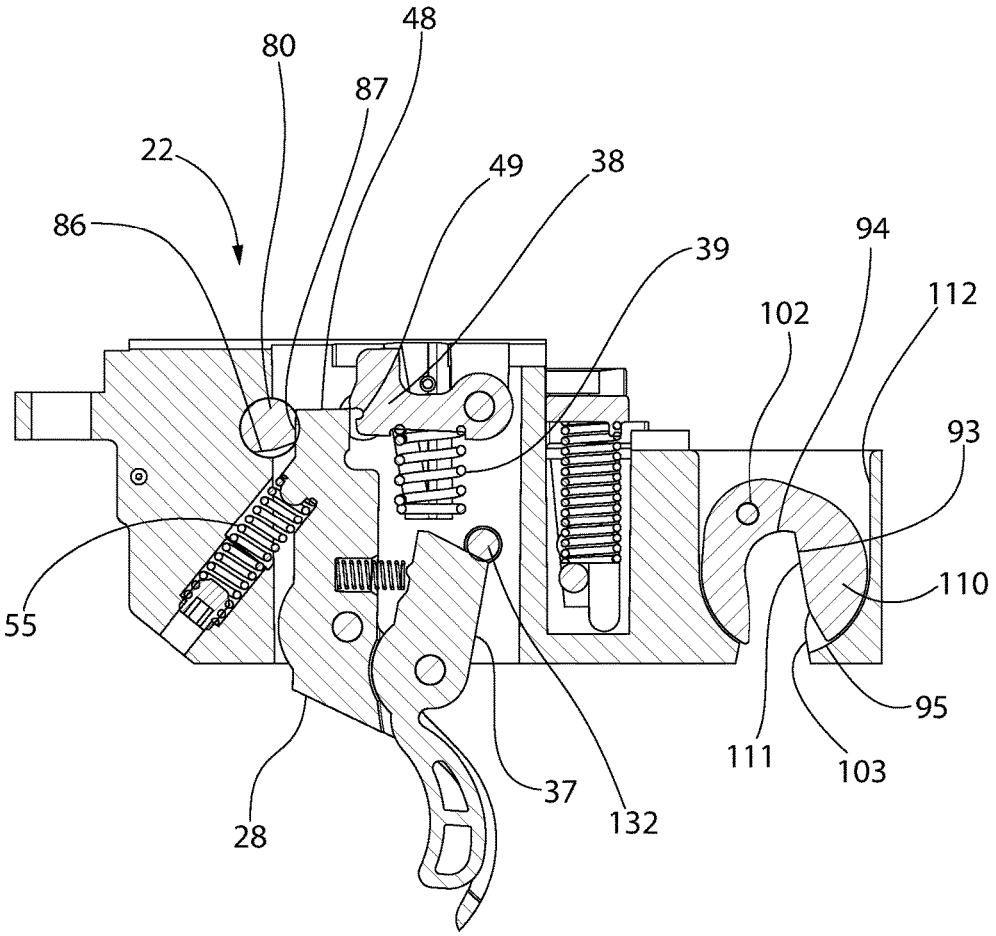
FIG. 10B is left side cross-sectional view thereof.
Figure 11A:
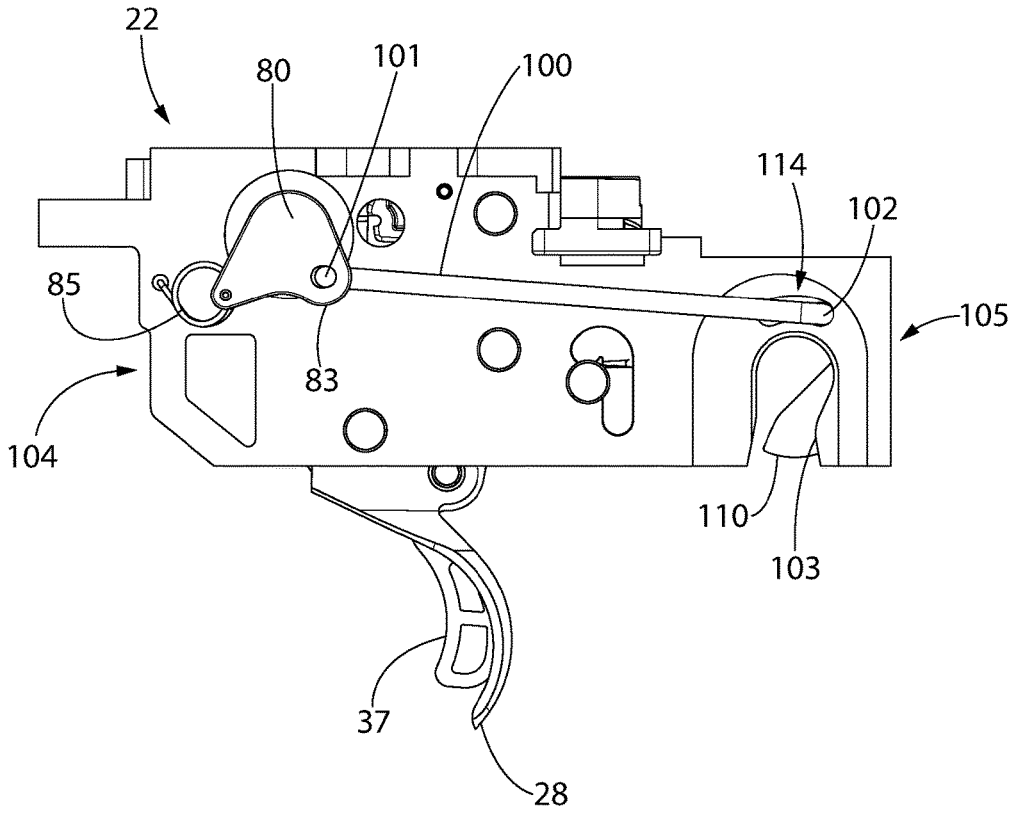
FIG. 11A is a left side view thereof associated with the safety selector in a "fire" firing mode position and the safety shaft disengaging and allowing movement of the trigger to enable the firing mechanism.
Figure 11B:
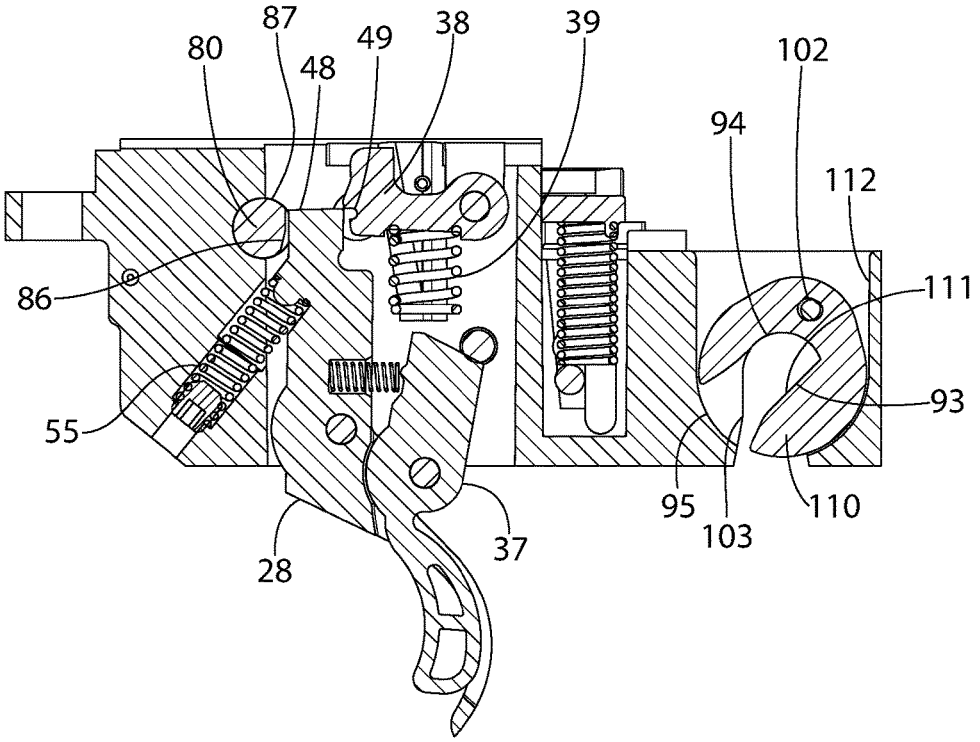
FIG. 11B is left side cross-sectional view thereof.

The rotary cam 110 is mounted in an upwardly open recess 112 formed near the rear end 105 of the trigger housing 22 (see, e.g. FIGS. 8, 10B, 11B). For point of reference, the safety shaft 80 is disposed near the front end 104 of the housing 22. Recess 112 has an axial width which is slightly but not overly larger than the diameter of the rotary cam body to allow the cam to be inserted downwards into the recess when the safety mechanism components are installed in the trigger housing 22. The recess 112 may have a U-shape in transverse cross section and circumscribes a downwardly open vertical slot 103 formed in the trigger housing 22. The slot 103 may extend transversely through both the right and left lateral sides 64, 65 of the housing. The lower portions of the recess 112 on each side of the slot 103 in trigger housing 22 are bounded by bottom arcuate walls 95 which complement and engage the circular shape of the body of the rotary cam 110 on each side of slot 111. The rotary cam 110 is seated and rotatable on the arcuate walls 95 when fully installed in the trigger housing. The lower end of the recess 112 is smaller than the diameter of the rotary cam 110 so that the cam cannot fall through the vertical slot 103 in the trigger housing 22.

Rotary cam 110 has a generally flat disk-like shape which is substantially but not perfectly circular in one embodiment as shown. In other embodiments, the shape may be perfectly circular. Rotary cam 110 has a downwardly open vertical slot 111 for upwardly receiving the safety selector control shaft 71 and an aperture 113 which receives a second hook-shaped curved end 102 of control rod 100 which is coupled thereto. Access through the trigger housing 22 for end 102 of the control rod to engage the aperture 113 of the rotary cam 110 may be provided through an arcuate slot 114 formed in the left lateral side 65 of the housing. The arcuate slot 114 is located to follow the arcuate path of the curved end 102 of the control rod 100 as the safety selector 70 is rotated.

The control shaft 71 of the safety selector 70 is removably received in both of the mating downwardly open slots 103, 111 disposed in the trigger housing 22 and the rotary cam 110, respectively. Slots 103 and 111 may have similar heights and axial widths which complement and are preferably slightly larger than the diameter of the safety selector control shaft 71 sufficient to allow both insertion and rotation of the shaft when positioned therein. Slot 111 of the rotary cam 110 has an open bottom end and a closed top end with a shape complementary to the shape semi-circular shape of the portion of the control shaft 71 containing the flat surface 76. Accordingly, the top end of slot 111 has a mating flat surface 93 and arcuate surface 94 (see, e.g. FIGS. 9, 10B, 11B). This provides a relatively tight interlocking fit and engagement between the control shaft 71 and rotary cam 110 such that rotating the shaft 71 concomitantly rotates the rotary cam.

The safety mechanism is operated in the following manner. Safety selector 70 is first assumed to be in the downward "fire" position shown in FIGS. 11A-C. The selector switch 74 is thus oriented obliquely to the longitudinal axis LA. In one embodiment, the selector switch 74 may be disposed at approximately 45 degrees to the longitudinal axis. The rotary cam 110 is oriented so that the lower rear quadrant obstructs the vertical slot 103 of the trigger housing 22. The rear curved end 102 of the control rod 100 is positioned at the rear of arcuate slot 114. The safety shaft 80 is in the unblocking position with the flat operating surface 86 of the positioned parallel to and facing the front surface 66 of the trigger 28. When the trigger is pulled, there is sufficient clearance between the safety selector 70 and front surface 66 of trigger 28 to allow the trigger sear catch protrusion 44 to move and release the sear 38 and firing pin 26 for discharging the firearm.

Figure 10C:
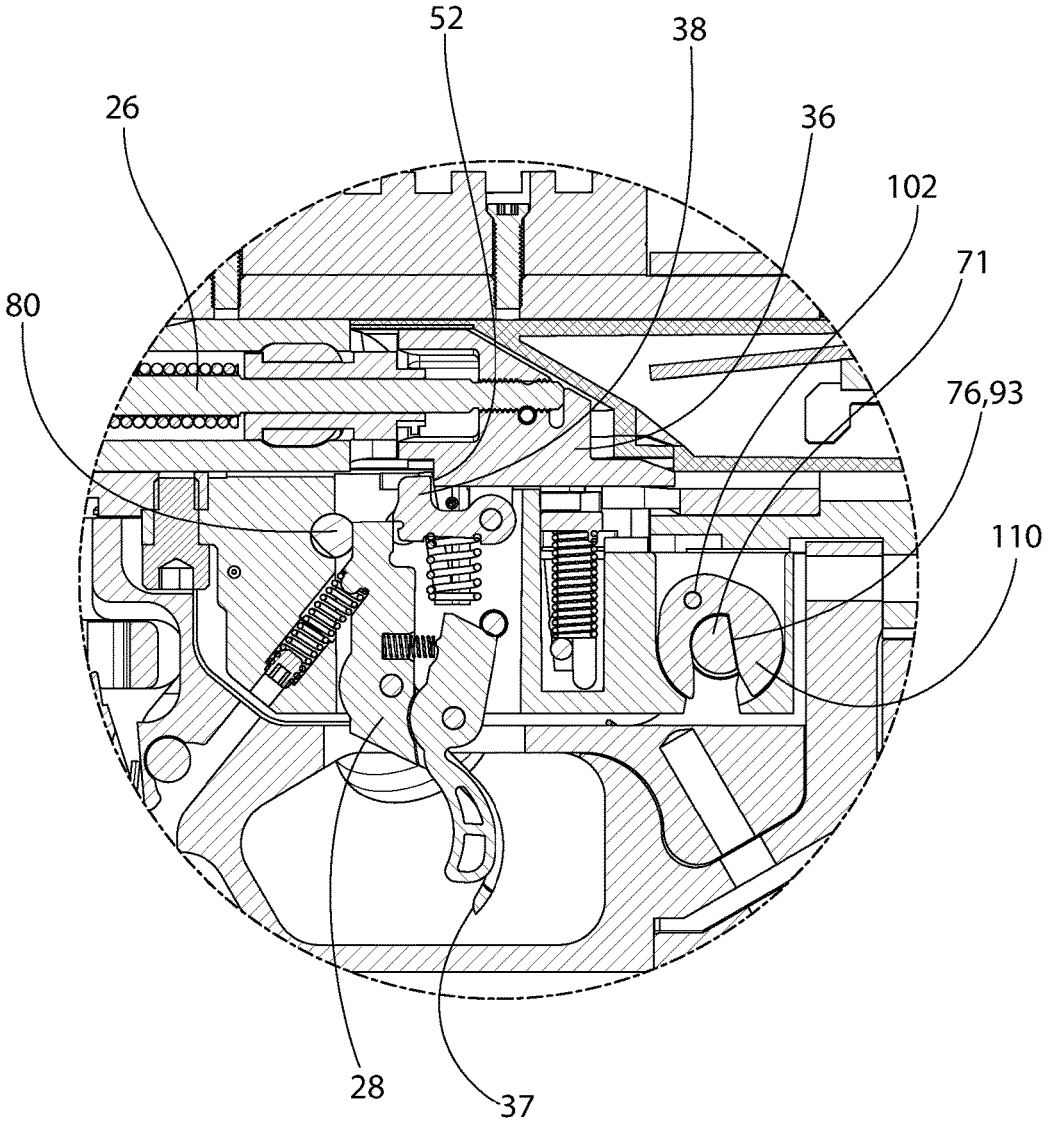
FIG. 10C is a left side cross-sectional view thereof showing portions of the receiver containing additional firing mechanism components which interact with the firing mechanism components of the trigger housing.

To activate the safety, the user moves and rotates the selector switch 74 upwards (counter-clockwise) to the horizontal "safe" position parallel to longitudinal axis LA as shown in FIGS. 10A-C. This concomitantly rotates the control shaft 71 of the safety selector 70 counter-clockwise. The rotary motion of the safety selector 70 moves or translates the control rod 100 axially forward. The curved end 102 of the control rod moves forward in turn to the front of the arcuate slot 114. The rotary cam 110 rotates counter-clockwise with the safety selector control shaft 71 such that the vertical slot 111 of the cam becomes vertically aligned with and approximately parallel to slot 103 of trigger housing 22. This would allow removal of the lower stock 60 from the receiver 21 if the firearm 20 were to be disassembled at this point, as already explained herein.

Figure 11C:
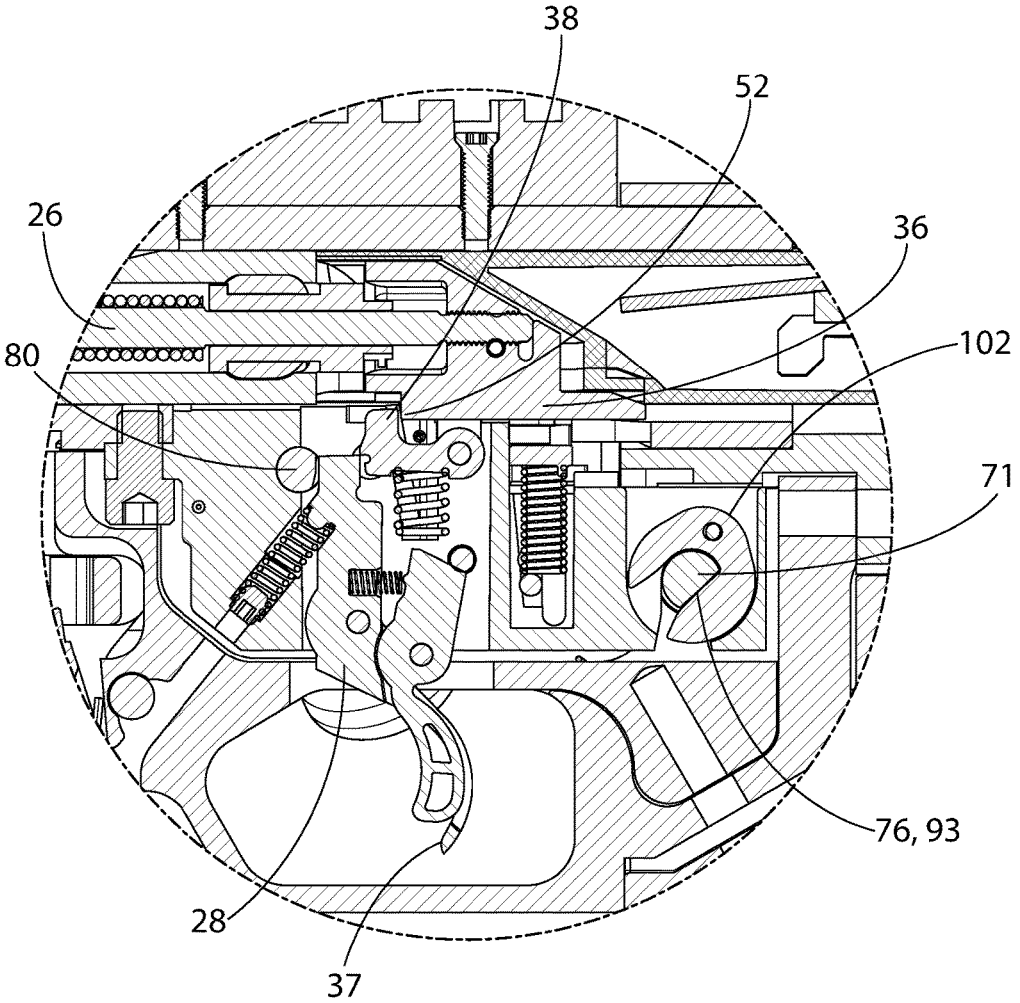
FIG. 11C is a left side cross-sectional view thereof showing portions of the receiver containing additional firing mechanism components which interact with the firing mechanism components of the trigger housing.

Counter-clockwise rotation of the safety selector 70 and accompanying forward movement of the control rod 100 in turn simultaneously rotates the safety shaft 80 clockwise (see again FIGS. 11A-C). The safety shaft 80 is now in the blocking position such that the flat operating surface 86 of the shaft has rotated forward and the arcuate blocking surface 78 has rotated rearward into engagement with the front surface 66 of the trigger 28. When a trigger pull is attempted, there no longer is sufficient clearance between the safety selector 70 and front surface 66 of trigger 28 to allow the sear catch protrusion 44 on the trigger to release the sear 38 and firing pin 26 for discharging the firearm. Instead, pivotal movement of the trigger is arrested, thereby disabling the firing mechanism.

The vertical slot 111 of the rotary cam 110 is rotatable in orientation with respect to the vertical slot 103 of the trigger housing 22 which remains stationary and fixed in position when mounted to the receiver 21. In another aspect of the invention, relative rotation between the rotary cam 110 and trigger housing 22 advantageously forms an interlock mechanism which prevents removal of the lower housing 60 from the receiver 21 when the safety selector 70 is in the "fire" position. The safety selector control shaft 71 is captured by the rotary cam 110 and the trigger housing 22, thereby preventing the lower assembly from being removed. While a firearm should always be unloaded before disassembly as dictated by responsible handling procedures, this mechanism is beneficial in that it ensures the safety of the firearm is engaged before the lower stock 60 can be removed and the trigger assembly is exposed. It also prevents the firearm from being re-assembled with the safety in the fire position.

Figure 4:
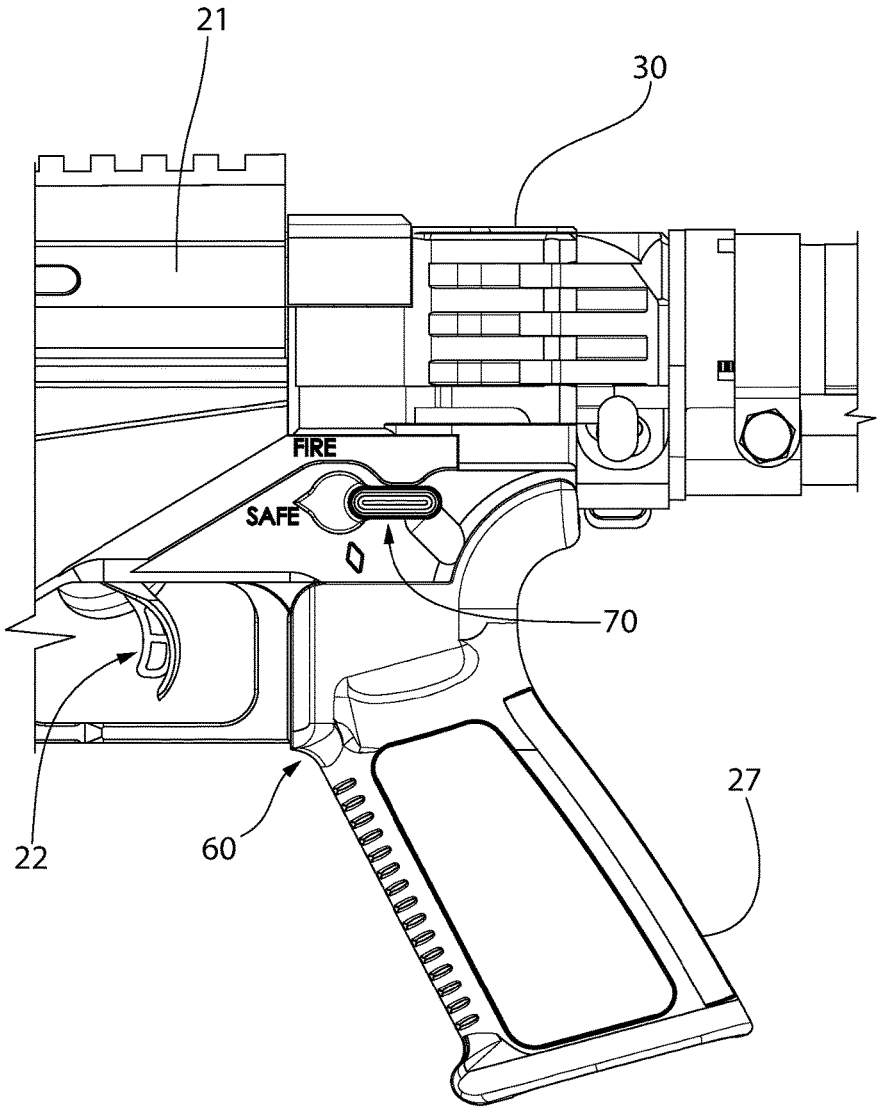
FIG. 4 is a partial left side view of the firearm showing the safety selector and pistol grip area of the firearm.

When the safety selector 70 is in the "safe" position shown in FIGS. 10A-C, the vertical slots 103, 111 of the trigger housing 22 and rotary cam 110 are vertically aligned and fully open to at least the full diameter of the control shaft 71 of the safety selector. This allows the control shaft and safety selector 70 to be withdrawn downwards and removed from the slots 103, 111 with the lower stock 60 (in which the safety selector is rotatably mounted as shown in FIG. 4) to exposed the trigger housing 22 and trigger mechanism. Conversely when the safety selector 70 is in the "fire" position shown in FIGS. 11-C, the vertical slots 103, 111 of the trigger housing 22 and rotary cam 110 are no longer vertically aligned and fully open to at least the full diameter of the control shaft 71 of the safety selector. The lower rear quadrant of the rotary cam now protrudes partially into and obstructs the slot 103 of the trigger housing 22 by a sufficient amount to prevent the control shaft 71 from passing downwards therethrough. Rotary cam slot 111 is no longer vertically aligned with but rather obliquely orientated to slot 103 of the trigger housing which traps the control shaft 71 of the safety selector 70 in the cam. This prevents the control shaft and safety selector 70 from being withdrawn downwards and removed from the slots 103, 111 when in the "fire" position so that the lower stock 60 cannot now be detached from the receiver 21, thereby forming an interlock mechanism.

Trigger Housing Mounting System

According to another aspect of the invention as described above, the trigger housing 22 which carries the trigger-actuated firing mechanism may be removably attached to the receiver 21. One non-limiting embodiment of a trigger housing mounting system 200 utilizes a sliding T-slot arrangement in the receiver and trigger housing in combination with secondary retention features which prevent unintentional sliding and dismounting of the trigger housing.

The mounting system will now be further described in greater detail with initial reference to FIGS. 9, 30-38, and 49.

Trigger housing 22 includes a top 201, bottom 202, front 203, rear 204, and opposing right and left lateral sides 205, 206 extending axially between the front and rear. A longitudinally-extending internal cavity 207 is formed in the trigger housing which carries and supports the trigger-actuated fire control mechanism components (e.g. trigger, sear, etc.) already described herein. Trigger housing 22 includes a lower portion 260 which supports the trigger assembly 28 and an upper mounting portion configured and dimensioned for detachable coupling to the bottom 211 of the receiver 21.

The trigger housing 22 may be formed of any suitable metallic or non-metallic material (e.g. polymers, etc.). In one example, the trigger housing is formed of a light-weight metal such as aluminum or titanium.

In one embodiment, the upper mounting portion 261 of trigger housing 22 includes a plurality of laterally extending mounting flanges or tabs 91 which interlock with mating flanges or tabs 208 formed in the underside of the receiver 21 to suspend the housing from beneath the receiver. Tabs 91 are disposed adjacent to the top 201 of the trigger housing and may share a contiguous upper surface with the housing. In one arrangement, a pair of longitudinally spaced apart front and rear mounting tabs 91*a*, 91*b* is formed on the left lateral side 206 and opposing front and rear mounting tabs 91*c*, 91*d* are formed on the right lateral side 205. Laterally open recesses or cutouts 209 and 210 are formed between tabs 91*a*-*b* and 91*c*-*d* respectively which each allow insertion of one of the receiver tabs 208 when mounting the trigger housing. The tabs 91*a*-*d* may each have chamfered or radiused/rounded front and rear corners (best shown in FIG. 30) to facilitate attachment to the receiver 21 and sliding thereon as further described herein.

The bottom wall 211 of receiver 21 includes a longitudinally-extending trigger housing mounting slot 212 configured and dimensioned for insertion of the top of the trigger housing 22 with mounting tabs 91*a*-*d*. Slot 212 includes a front end 212*a* and opposing rear end 212*b*. Tabs 208 formed on the underside of the receiver include a pair of longitudinally spaced apart front and rear mounting tabs 208*a*, 208*b* formed on the left side of slot 212 and opposing front and rear mounting tabs 208*c*,2081*d* are formed on the right side of the slot (see, e.g. FIGS. 31 and 33). Tabs 208*a*-*d* may be formed by an integral structural part of the receiver body of the receiver itself in some embodiments, or may be separate structures coupled to the receiver. The manner of forming the tabs is not limiting.

Longitudinally spaced apart and inwardly open recesses or cutouts 213*a* and 213*b* are formed in the receiver 21 on the left side of the elongated slot 212. Cutout 213*a* is formed between tabs 208*a* and 208*b*. Cutout 213*b* is formed at the rear of tab 208*b*. Similarly arranged on the right side of the elongated slot 212 are longitudinally spaced apart and inwardly open cutouts 213*c* and 213*d* formed in the receiver. Cutout 213*c* is formed between tabs 208*c* and 208*d*. Cutout 213*d* is formed at the rear of tab 208*d*. The cutouts 213*a-d* open inwardly onto and are in communication with the mounting slot 212. Cutouts 213*a-d* are contiguous in structure with and open inwards into the mounting slot 212 so as to be positioned laterally adjacent to and adjoining the mounting slot. Cutouts 213*a-d* are configured and dimensioned to receive mounting tabs 91*a-d* of the trigger housing 22 therethrough.

It should be noted that formation of the cutouts 213 in the receiver and cutouts 209, 210 in the trigger housing is not restricted to physical cutting or milling fabrication processes alone, and may be created by other means such as in the casting or molding of the receiver and trigger housing. Accordingly, the term "cutout" is used herein in a descriptive sense to convey the shape and nature of the feature, and not in a restrictive sense with respect to the fabrication method used to form the feature.

Although two pairs of cutouts 213*a-d* and two pairs of mounting tabs 91*a-d* are illustrated herein, in other embodiments a single pair of opposing and axially longer mounting tabs 91*a* and 91*d* may be provided on opposite sides of the trigger housing 22. The two longer mounting tabs 91*a* and 91*d* would then be paired with a single pair of axially longer cutouts 213*a* and 213*c*. Accordingly, any number of mating mounting tabs and cutouts may be provided which is not limiting of the invention. In yet additional embodiments, non-opposing tab arrangements may be used.

Axially elongated left and right undercut slots 214*a*, 214*b* are cut or otherwise formed in the bottom wall 211 of the receiver 21 on each of the left and right sides of the mounting slot 212. Both undercut slots 214*a-b* are inwardly open towards the mounting slot 212 and communicate with the mounting slot and cutouts 213*a-d*. On the left side, undercut slot 214*a* extends continuously from beneath mounting tab 208*a* rearwards to the rear end of cutout 213*b*. Similarly on the other right side, undercut slot 214*b* extends continuously from beneath mounting tab 208*c* rearwards to the rear end of cutout 213*d*. When the trigger housing 22 is in the process of being mounted to the receiver 21, the mounting tabs 91*a-d* on the housing slide in the undercut slots 214*a-b*, as further described herein.

Figure 31:
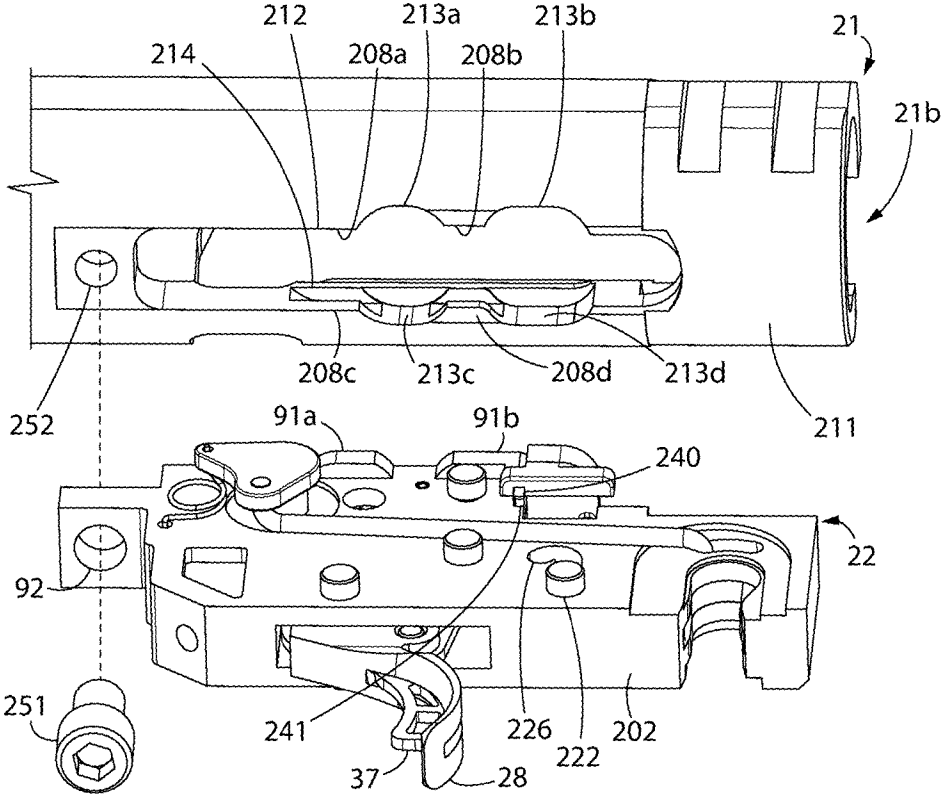
FIG. 31 is an exploded bottom perspective view of the receiver and trigger housing.
Figure 33:
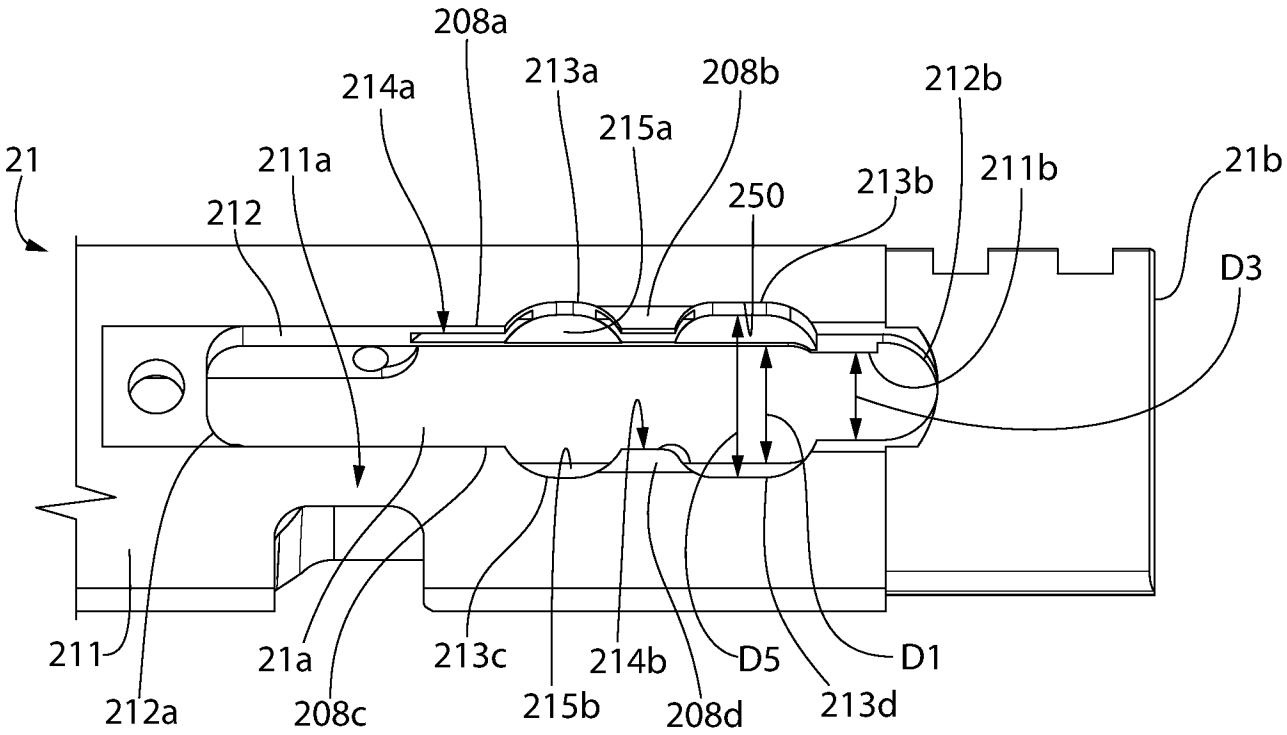
FIG. 33 is a bottom perspective view of the receiver showing the trigger housing mounting slot and related features.

It bears noting that undercut slots 214*a* and 214*b* do not extend vertically downwards in a manner which penetrates through the bottom wall 211 of the receiver except where the slots intersect the cutouts 213*a-d* which are in communication with the mounting slot 212 (see, e.g. FIGS. 31 and 33). The undercut slots 214*a*, 214*b* further do not extend vertically upwards in a manner which penetrates through the bottom wall of the receiver. Accordingly, the undercut slots 214*a-b* have depth less than the thickness of the receiver bottom wall 211 and are disposed between the exterior surface 211*a* and interior surface 211*b* of the receiver 21. This defines and forms left and right horizontal partition ledges or walls 215*a*, 215*b* with undercut slots 214*a*, 214*b* respectively which limit the insertion depth of the trigger housing 22 when mounted to the receiver. The upward facing top surfaces of the mounting tabs 91*a-d* on the trigger housing 22 contact the mating downward facing surfaces of partition walls 215*a*, 215*b* which properly locates the tabs in the undercut slots 214*a* and 214*b* of the receiver, and further prevent over insertion of the trigger housing into the axially extending internal cavity 21*a* of receiver 21 which holds the movable bolt 25 (see also FIG. 3). Accordingly, to achieve this functionality, partition walls 215*a*, 215*b* each have longitudinally-extending linear edges within mounting slot 212 which are separated by a transverse distance D1 less than the total transverse width D2 of the trigger housing 22 measured between the outside edges of laterally opposite pairs of mounting tabs 91*a*, 91*c* and 91*b*, 91*d* (see FIG. 30).

According to another aspect of the trigger housing mounting system, a secondary retention feature in the form of a spring-biased locking block 220 is provided. Because the trigger housing 22 is slidably mounted to the receiver 21 using the mounting tabs and slot arrangement, the locking block prevents unintentional sliding and detachment of the trigger housing during operation of the firearm.

Figure 43:
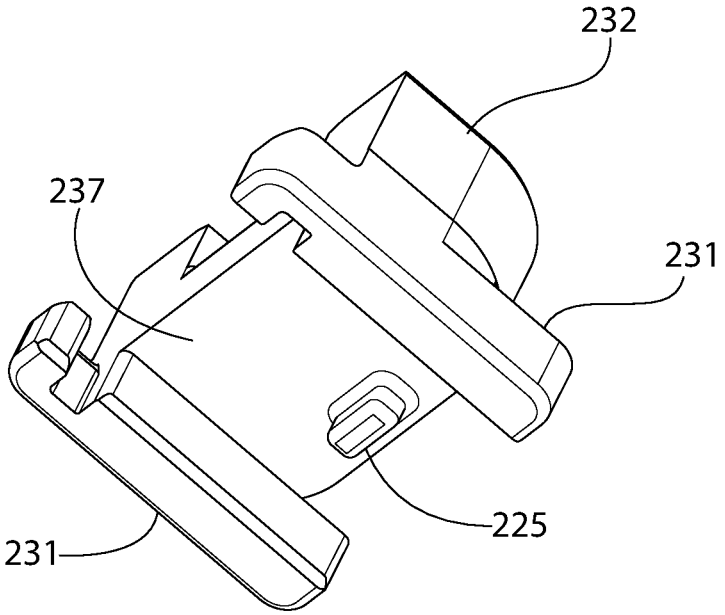
Figure 44:
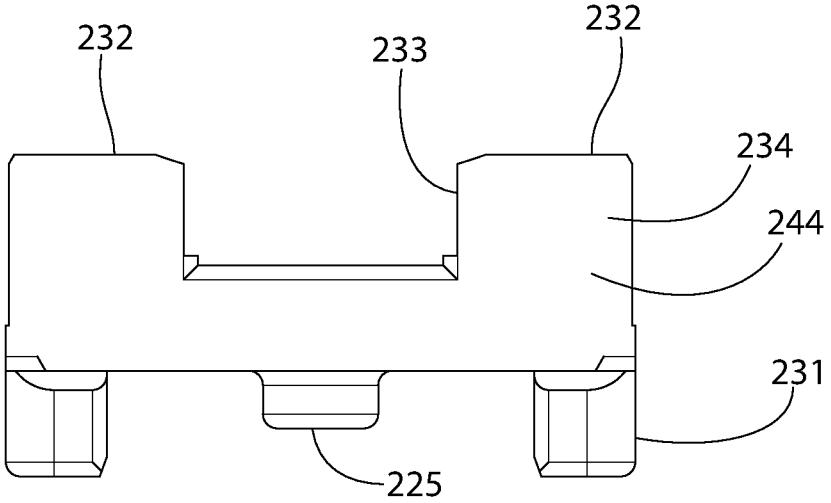
FIGS. 44 and 45 are front and rear views of the locking block.
Figure 45:
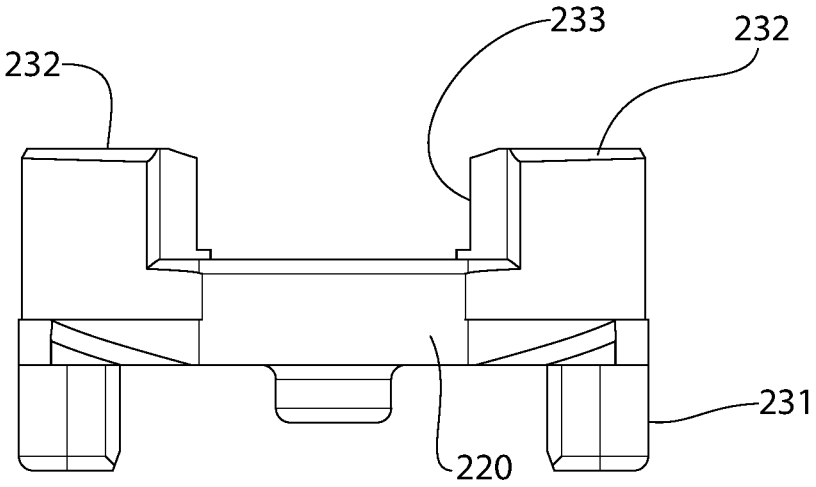
Figure 46:
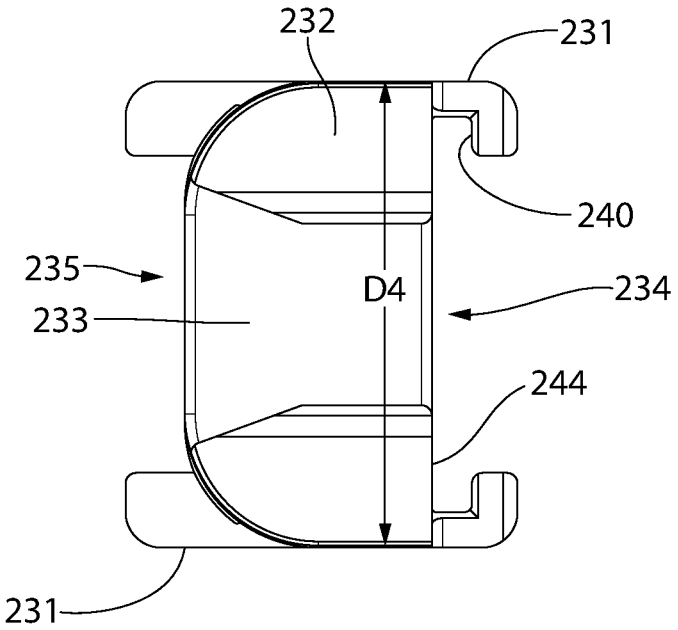
FIGS. 46 and 47 are top and bottom plan views of the locking block.
Figure 47:
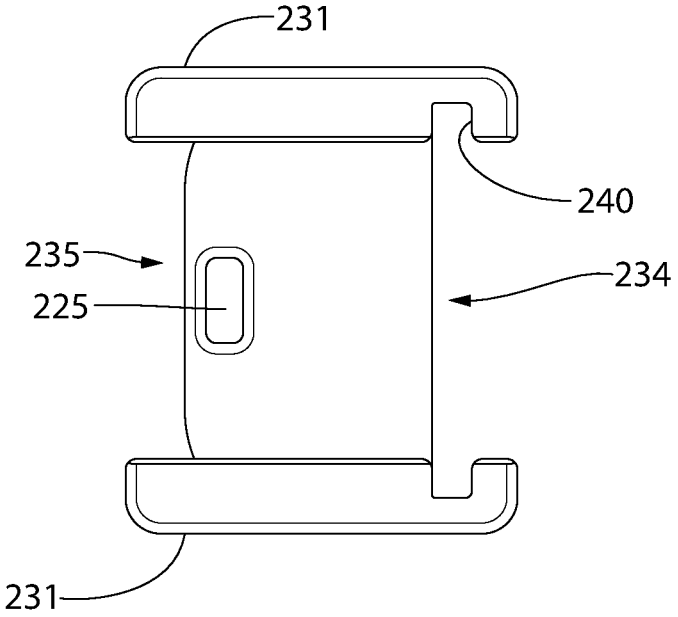
Figure 48:
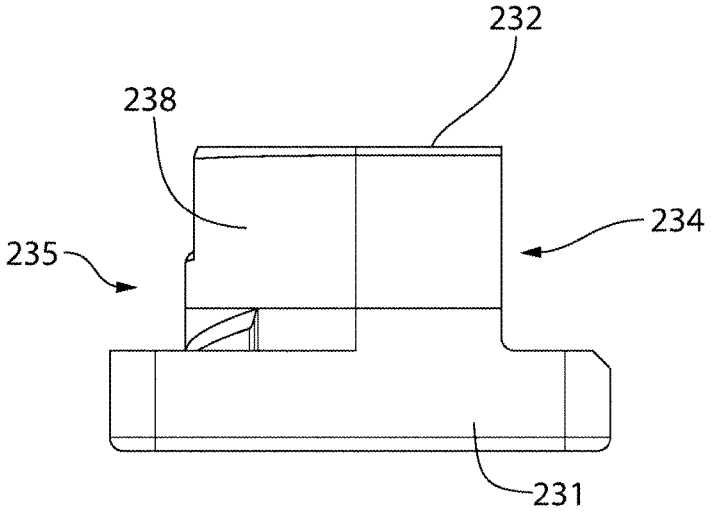
FIG. 48 is a side view of the locking block.
Figure 49:
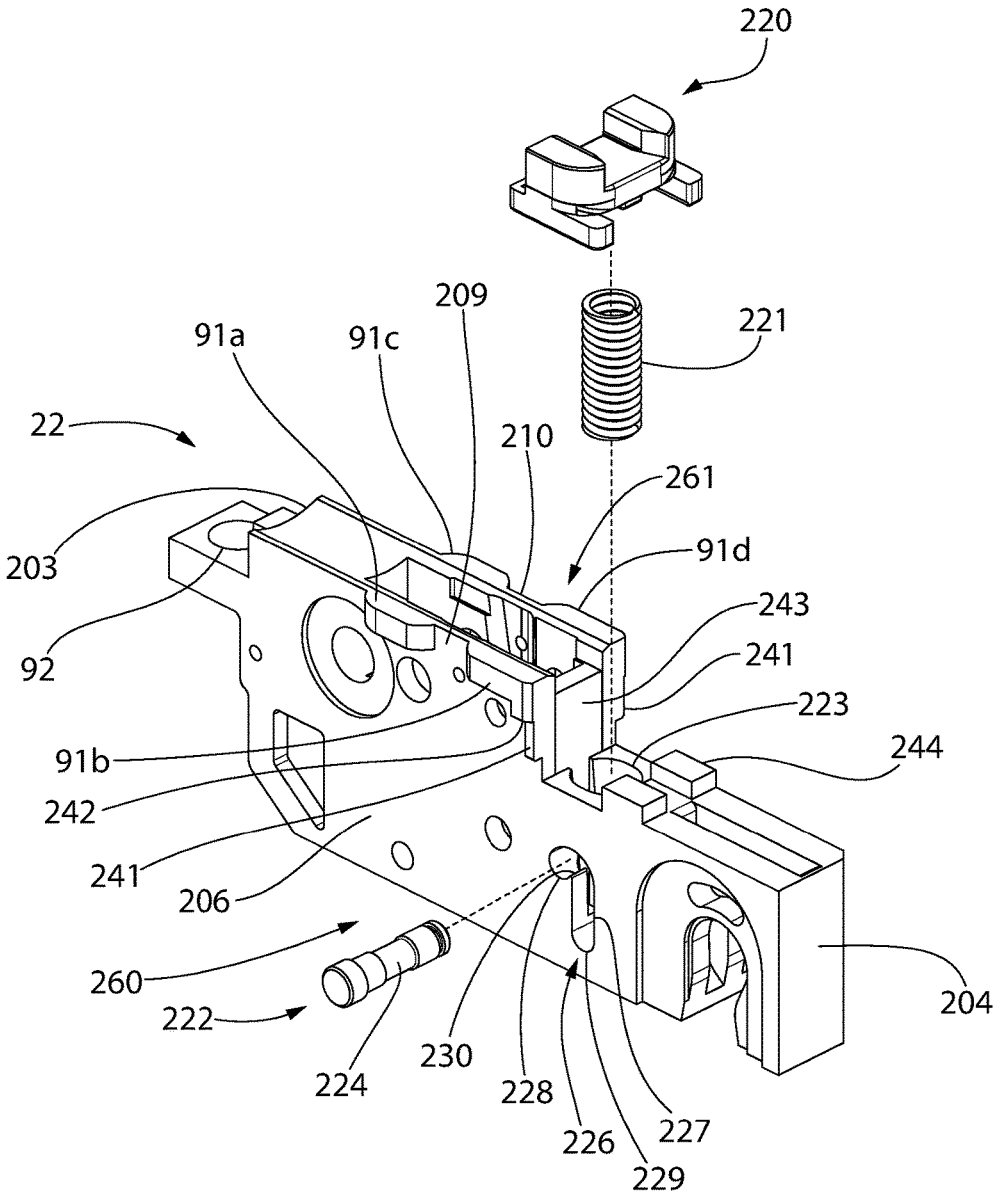
FIG. 49 is an exploded perspective view of the trigger housing.

Referring generally to FIGS. 9 and 30-49, the locking block assembly generally comprises locking block 220, spring 221, and transverse lock pin 222. Locking block 220 is mounted on the top of the trigger housing 22 rearward and immediately adjacent to mounting tabs 91*b* and 91*d*. An elongated vertical and upwardly open socket 223 receives the spring 221 therein. Spring 221 is oriented vertically within the trigger housing 22. The bottom end of spring 221 engages lock pin 222 and the top end engages the underside of locking block 220. Lock pin 222 is cylindrical and may have a reduced diameter central portion 224 in some embodiments. This forms a spring seat between two opposing laterally spaced apart shoulders on each side of the central portion (see, e.g. FIG. 49) to engage the bottom end of the spring 221 and help retain its position. The underside of the locking block 220 may include a spring retention protrusion 225 (best shown in FIG. 43) which engages and retains the top end of spring 221 in position on the block. In one embodiment, spring 221 may be a helical compression spring. Other type springs however may be used.

Lock pin 222 is laterally inserted through a hooked generally J-shaped locking slot 226 formed transversely through the trigger housing 22. Matched slots 226 are formed in both the right and left lateral sides 205, 206 of the housing and extend completely through the sides (seen for example in FIGS. 37 and 49). Locking slot 226 communicates with the vertical socket 223 in trigger housing 22 which contains spring 221. In one embodiment, the lock pin 22 preferably protrudes outwards beyond the lateral sides for grasping by the user to manipulate the lock pin. The left side of the pin 222 protruding from left lateral side 205 may have an enlarged head which prevents full insertion of the pin through the locking slot 226. On the right lateral side 206, the lock pin 222 protrudes outwards and contains an annular groove which receives lock ring 262 (see, e.g. FIGS. 37-38). This positively locks and retains the lock pin 222 in position in the trigger housing 22 preventing lateral pullout.

Locking slot 226 includes a bottom end 229, a recurvant top end 228, and a vertical linear track 227 extending between the ends. Bottom end 229 is vertically aligned with the linear track 227. Top end 228 however is vertically offset from the linear track 227 and bottom end 229 of slot 226. The recurvant top end 228 is disposed at a higher elevation than the bottom end 229 such that the portion of the locking slot 226 that contains the top end is vertically shorter than the portion containing the bottom end and linear track. An upwardly turned ledge 230 is formed by the body of the trigger housing 22 between the top of the linear track and recurvant top end 228 at a directional transition point as shown which retains the lock pin 222 in the shortened portion of the slot 226 in top end 228 (see FIGS. 39-40).

Movement of the lock pin 222 from the bottom end 229 upwards in the linear track 227 to the recurvant top end 228 is resisted by the downward biasing force of spring 221 acting on the lock pin which urges the pin into the bottom end of the slot 226. Once positioned in the recurvant top end 228, the lock pin 222 is retained in the top end of the slot 226 by the spring 221 which acts downwards on the pin. The lock pin 222 may conveniently be moved into or out of the recurvant top end 228 of slot 226 with a thumb and forefinger of one hand gripping on the opposite ends of the pin which protrude slightly outwards in a lateral direction beyond each lateral side 205 and 206 of the trigger housing 22.

Lock pin 222 is movable between a locked position seated in recurvant top end 228 of the locking slot 226 and an unlocked position in the bottom end 229 of the slot. In the locked position, spring 221 is partially and minimally compressible such that locking block 220 is not vertically movable on the trigger housing 22 sufficiently to disengage the trigger housing mounting slot 212 for removing the housing from the receiver. This locks the housing to the receiver 21. The coils of the spring are now compressed and closely spaced forming almost a solid stack or structure acting like a retention pin. In the unlocked position, spring 221 is fully compressible and locking block 220 is vertically movable which unlocks the trigger housing from the receiver. Locking block 220 is movable between an upper locked position preventing sliding movement of the trigger housing 22 when mounted to the receiver and a lower unlocked position in which the trigger housing is slidable in the receiver.

The locking block includes a top 236, bottom 237, front 234, rear 235, and opposing right and left lateral sides 238 extending between the front and rear (FIGS. 42-48 show the locking block 220 in greater detail). The bottom includes a pair of parallel and laterally spaced apart mounting rails 231 form an axial passageway 239 therebetween which receives the top portion of trigger housing 22 therein on which the locking block 220 is mounted (i.e. upper portion immediately rearward of mounting tabs 91*b*, 91*d* at spring socket 223). This gives the lower portion of locking block 220 a generally U-shaped configuration in front/rear view with the mounting rails 231 protruding downwards from the bottom 237 of the locking block. Rails 231 may further protrude forward and rearward from the locking block 220 creating front and rear extensions of the rails to better stabilize and guide the vertical movement of the locking block.

With additional emphasis now on FIGS. 31, 32, 40, and 49, mounting rails 231 are arranged to hug and slidingly engage the right and left lateral sides 205, 206 of trigger housing 22. A vertical guide slot 240 is formed near the front end of each mounting rail 231 each of which slides upwards and downwards on a mating vertical guide bar 241 formed on opposite lateral sides of the trigger housing 22 forward of the locking block 220 (see also FIGS. 31 and 49). Guide slots 240 may be formed on the forward extensions of the mounting rails 231. The guide bars 241 and slots 240 may have a rectilinear cross sectional shape.

To prevent the locking block 220 from being ejected upwards from the trigger housing 22 by spring 221, a downward facing abutment surface 242 is formed on the right and left lateral sides 205, 206 of the housing. The abutment surfaces 242 are disposed at the upper terminal ends of the guide bars 241 and positioned to engage the tops of the mounting rails 231, thereby limiting the maximum upward travel of the locking block 220. In one embodiment, the abutment surfaces 242 may be formed on a downward extension of the rear mounting tabs 91*b* and 91D on trigger housing 22.

Locking block 220 further defines a forward facing vertical surface 244 which slidably engages a rearward facing vertical surface 243 of the trigger housing 22 when the locking block moves up and down on the housing. Theses mating sliding surfaces contribute to set the horizontal position of the locking block 220 on the trigger housing which cannot move forward beyond the surfaces. To prevent rearward movement of the locking block, a pair of upright protrusions 244 are formed on the trigger housing rearward and behind longitudinally spaced apart from mating surfaces 243, 244. The protrusions 244 slidably engage the rear 235 of the locking block 220 which prevent rearward movement of the block on the trigger housing. Engagement between the guide bars 241 and slots 240 further aids to fix the position of the locking block 220 on trigger housing 22.

Figure 41:
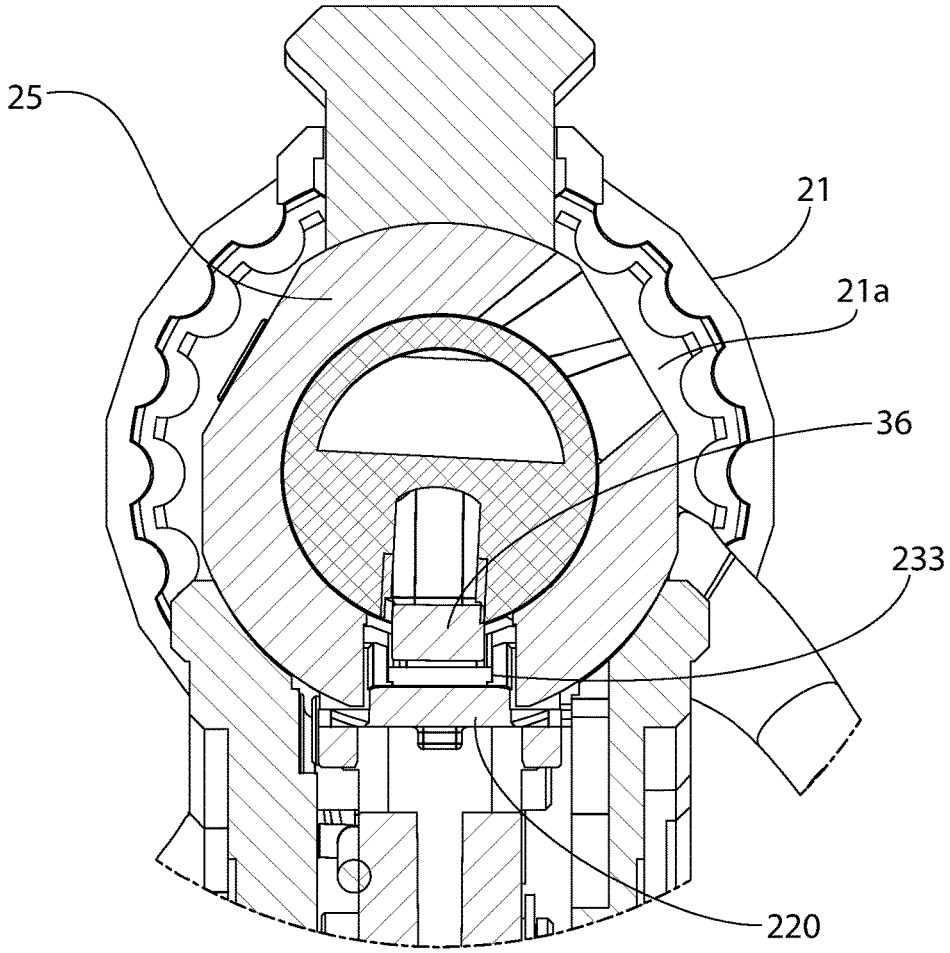
FIG. 41 is a transverse cross sectional view of the receiver and trigger housing showing the locking block and bolt with cocking piece positioned partially through the locking block.
Figure 42:
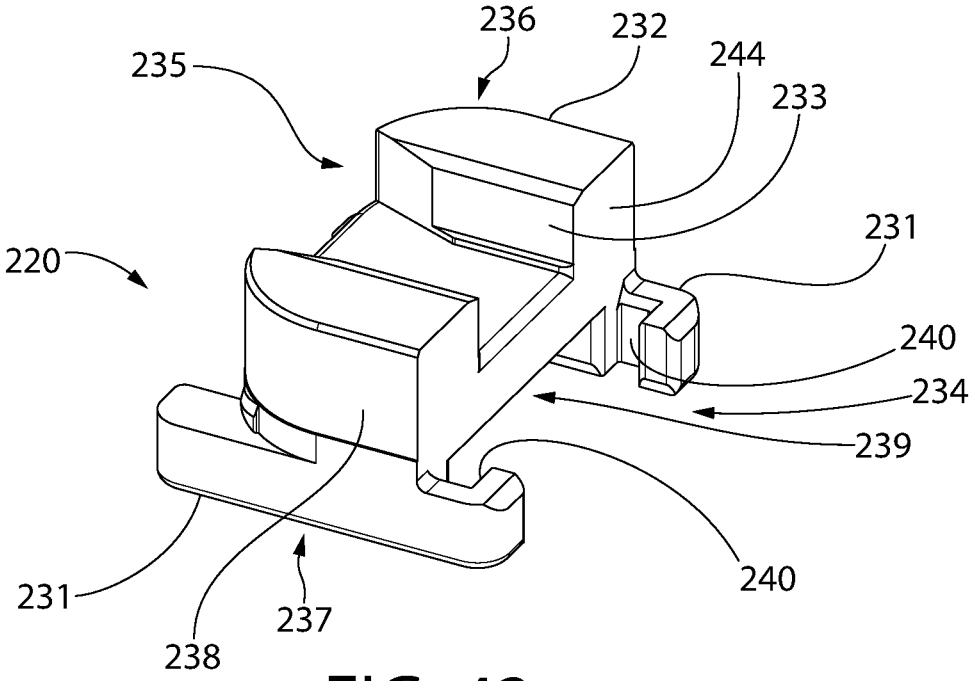
FIGS. 42 and 43 are top and bottom perspective views of the locking block.

Referring to FIGS. 42-48, the locking block 220 further includes a pair of laterally spaced apart and upwardly extending locking protrusions 232. An axial channel 233 is formed between the locking protrusions 232 which slidably receives the firing pin cocking piece 36 on the bolt 25 therethrough in some embodiments as shown in FIG. 41 (see also FIG. 3 and description above). In other embodiments where the configuration of the bolt does not require an axial channel for the cocking piece, a single upwardly extending locking protrusion may alternatively be provided instead of two. The invention is not limited to either a single or double locking protrusion which is selected based on the bolt configuration. The locking protrusions 232 are operable to selectively enter the mounting slot 212 on the bottom of the receiver 21 when mounting the trigger housing 22 thereto, as further described below.

A process or method for mounting trigger housing 22 on receiver 21 will now be described. FIG. 31 shows the uninstalled trigger housing 22 positioned below the receiver for mounting. The lock pin 222 is placed in the unlocked position at the bottom end 229 of the locking slot 226 so that the spring 221 remains compressible. The locking block 220 therefore is vertically movable (see also FIG. 39).

Figure 34:
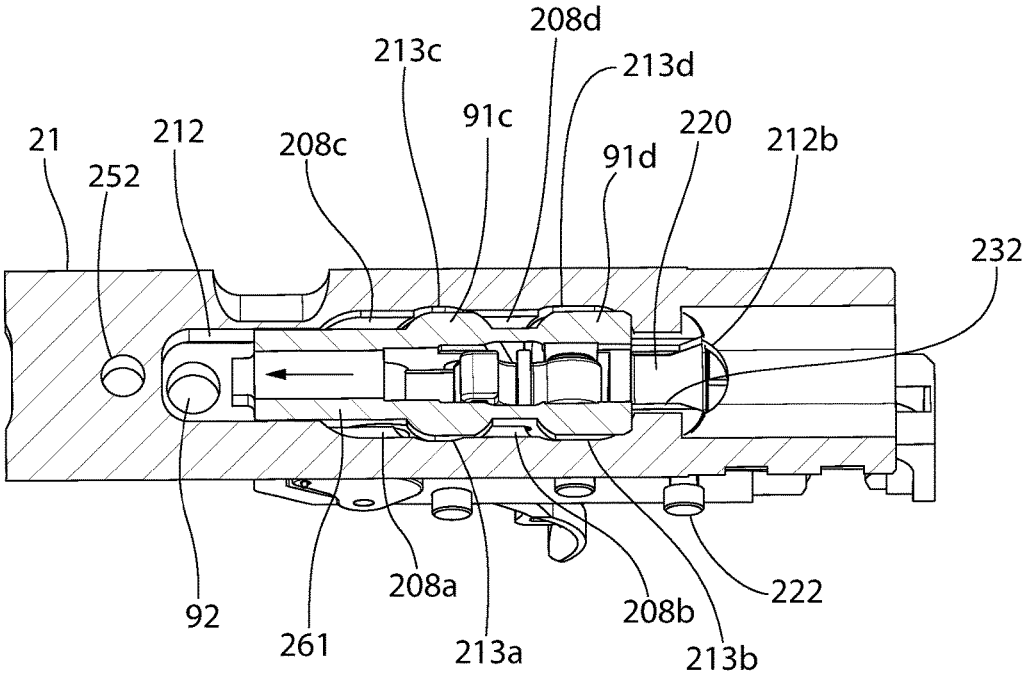
FIG. 34 is a top partial cross sectional perspective view showing the trigger housing in a rearward unlocked position attached to the receiver.
Figure 37:
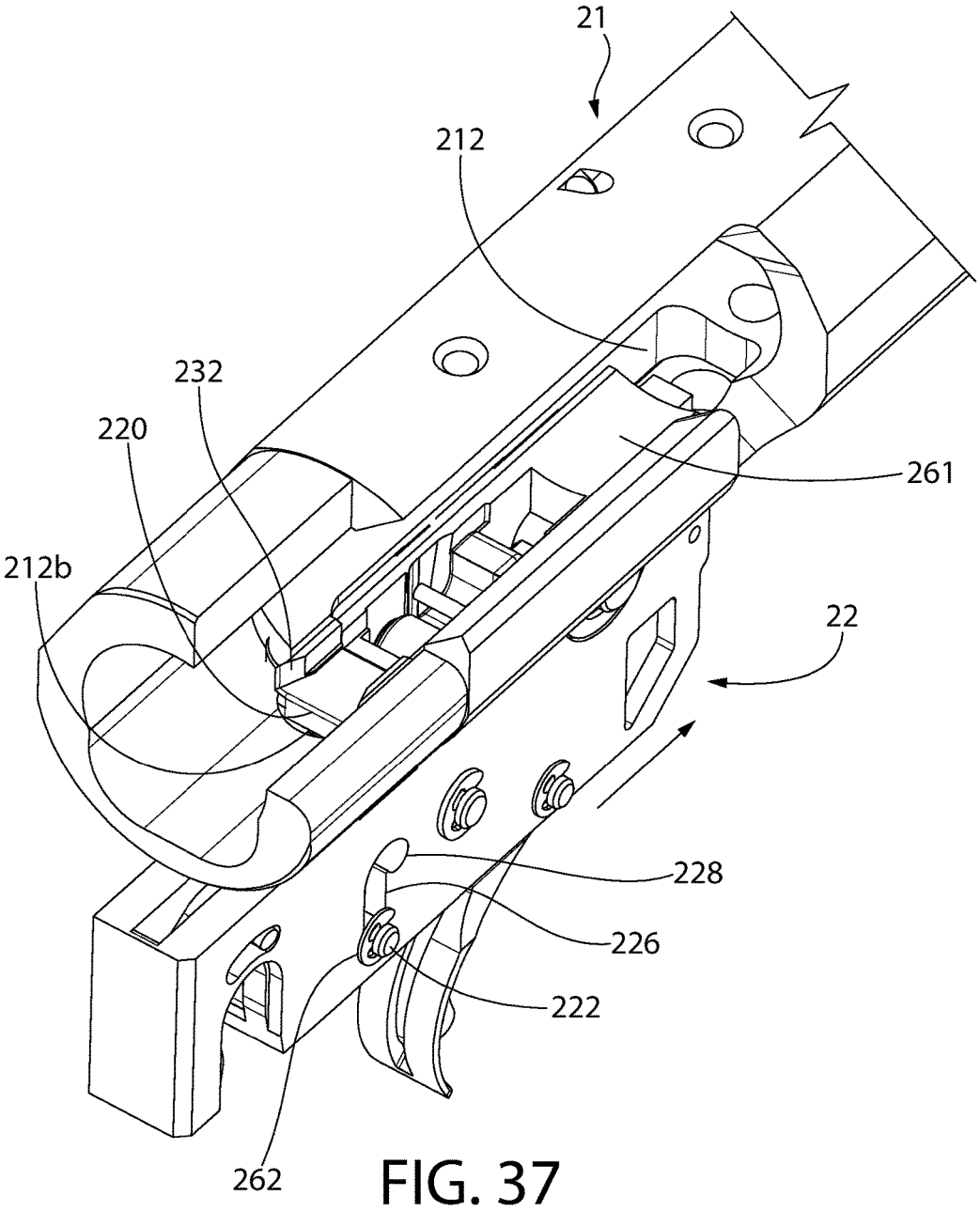
FIG. 37 is a top perspective view thereof showing the trigger housing in a rearward unlocked position attached to the receiver.

To install the trigger housing 22, the trigger housing is positioned below the receiver 21 to vertically align the mounting tabs 91*a-d* with receiver cutouts 213*a-d*. The trigger housing is then raised upwards to insert mounting tabs 91*a*, 91*b*, 91*c*, and 91*d* through cutouts 213*a*, 213*b*, 213*c*, and 213*d* in receiver 21, respectively. The top mounting portion 261 of the trigger housing comes into the mounting slot 212. Tabs 91*a-d* enter undercut slots 214*a*, 214*b*, and then abuttingly engage the underside of horizontal partition ledges or walls 215*a*, 215*b* in the receiver as the trigger housing is pushed upwards all the way. The tabs 91*a-d* are in a rearward position in undercut slots 214*a*, 214*b*. Concomitantly, the trigger housing 22 is in a rearward removable position in the trigger housing mounting slot 212 as the tabs 91*a-d* may still be vertically withdrawn downwards from the cutouts 213*a-d*. FIGS. 34 and 37 show this initial insertion position of the trigger housing 22 representing the rearward unlocked position of the trigger housing 22.

Concurrently with insertion of the tabs 91*a-d* described above, the top of the locking block 220 (i.e. locking protrusions 232) contacts the underside or bottom 211 of receiver 21. This displaces and moves the locking block downwards to the lower non-blocking position which compresses spring 221. The locking protrusions 232 of locking block 220 are positioned below the rear end 212*b* of the trigger housing mounting slot 212, but cannot enter the slot in this non-blocking position (see, e.g. FIGS. 34 and 37). This results from the locking block having a transverse width D4 measured across the locking protrusions 232 (labeled in FIGS. 30 and 46) which is larger than the transverse width D3 of the rear end 212*b* of the slot (labeled in FIG. 33). The locking protrusions 232 on the top of the locking block 220 thus remain outside and below slot 212 to engage the bottom of the receiver and are forced downwards by contact between the locking protrusions and bottom of the receiver when the trigger housing 22 is pressed against the receiver.

Figure 35:
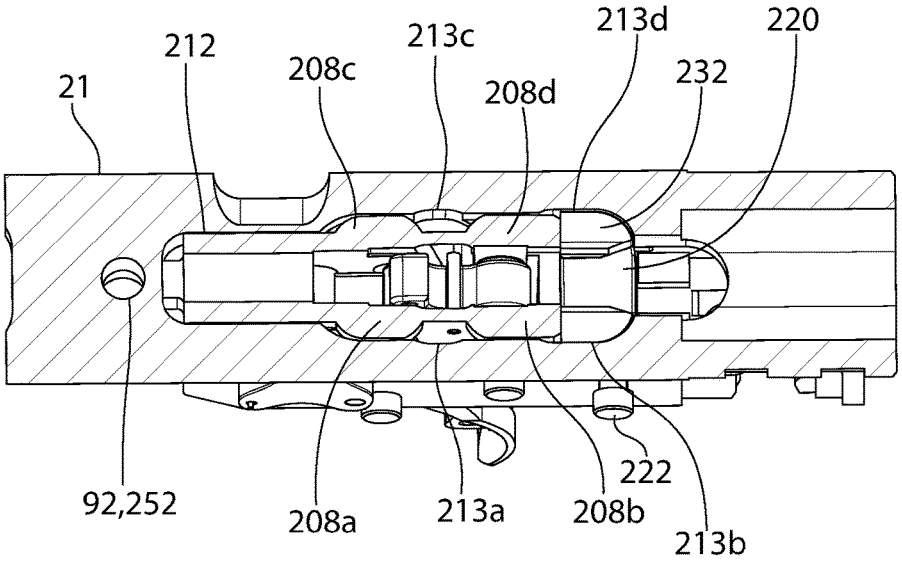
FIG. 35 is a top partial cross sectional perspective view showing the trigger housing in a forward locked position attached to the receiver.
Figure 36:
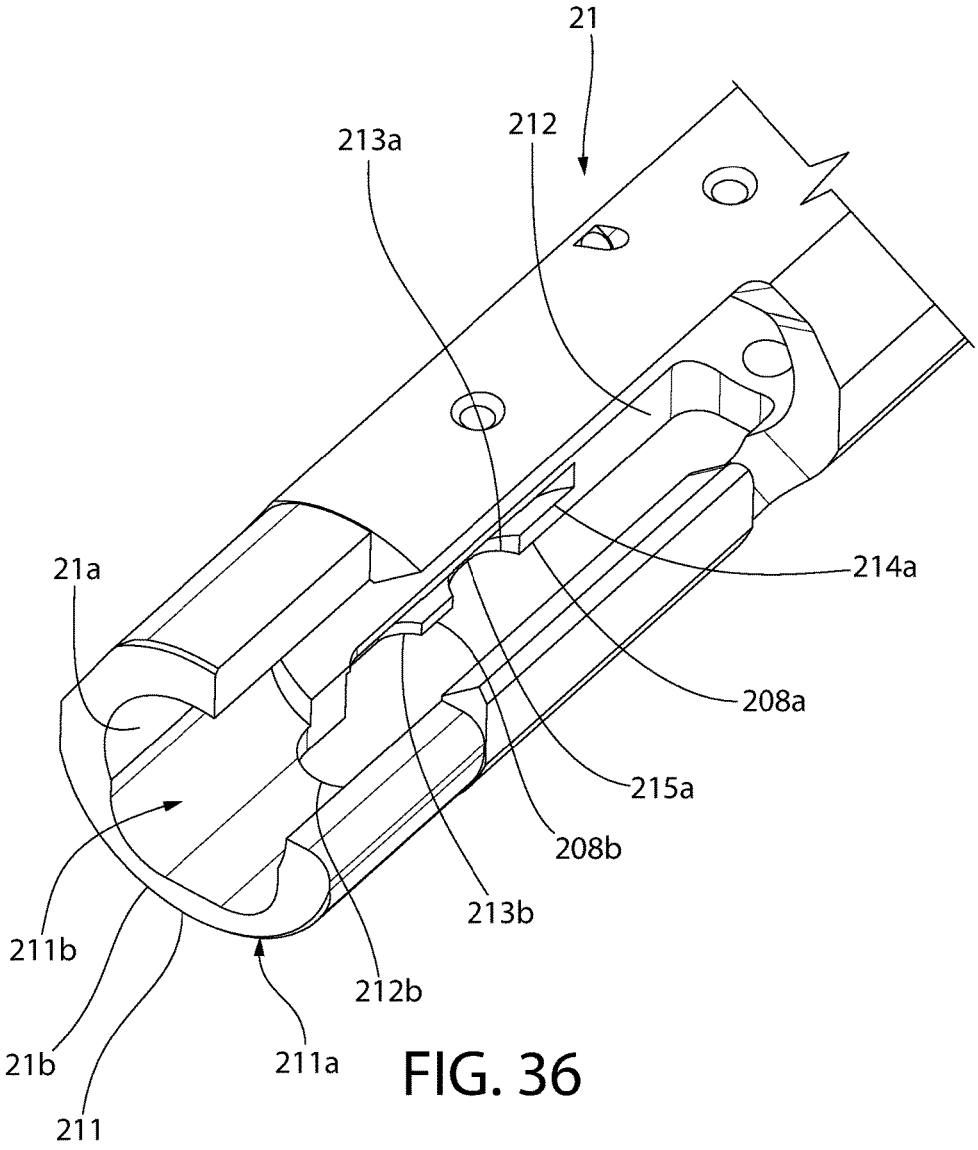
FIG. 36 is a top perspective view of the receiver body.
Figure 38:
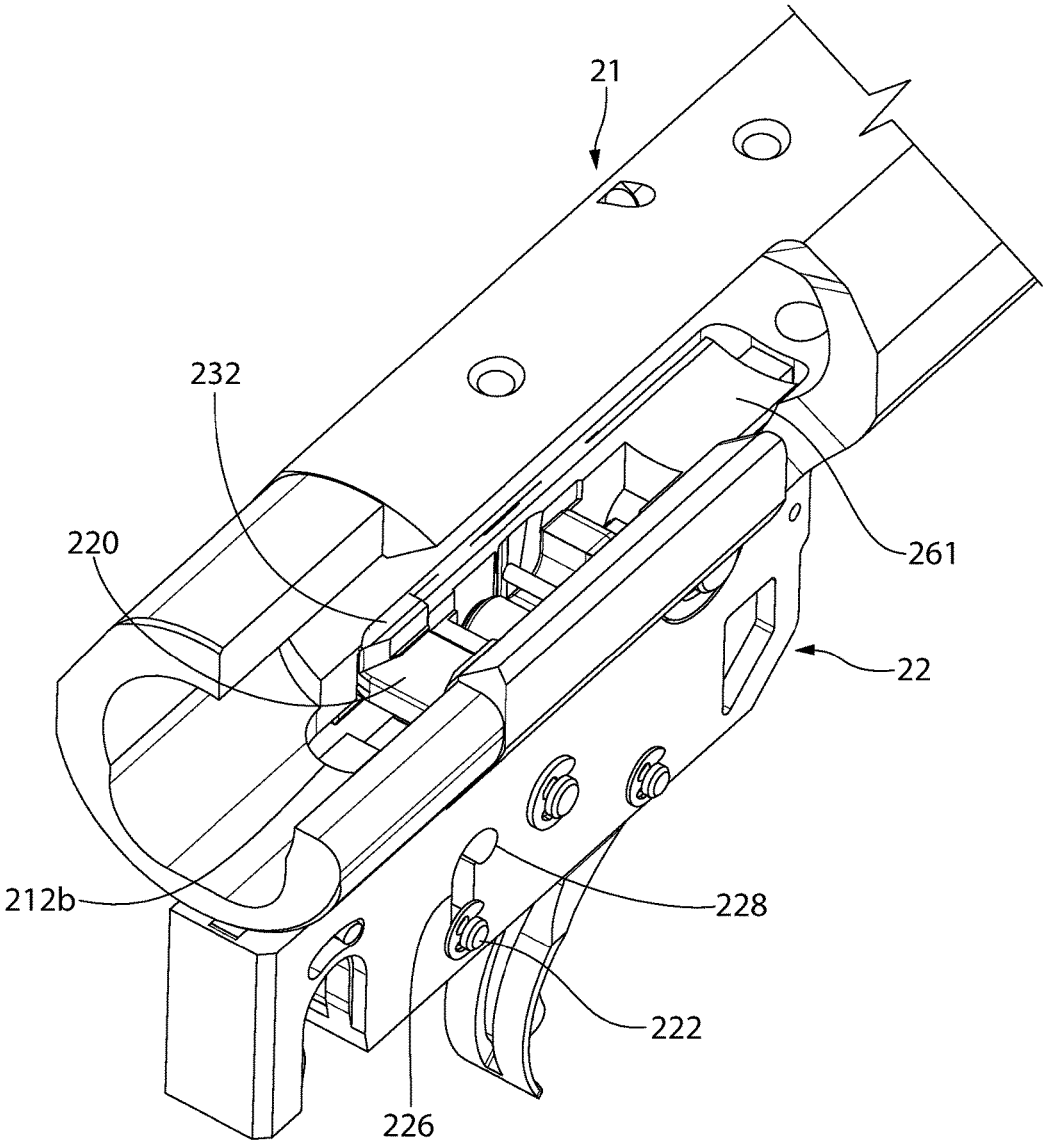
FIG. 38 is a top perspective view thereof showing the trigger housing in a forward locked position attached to the receiver.
Figure 39:
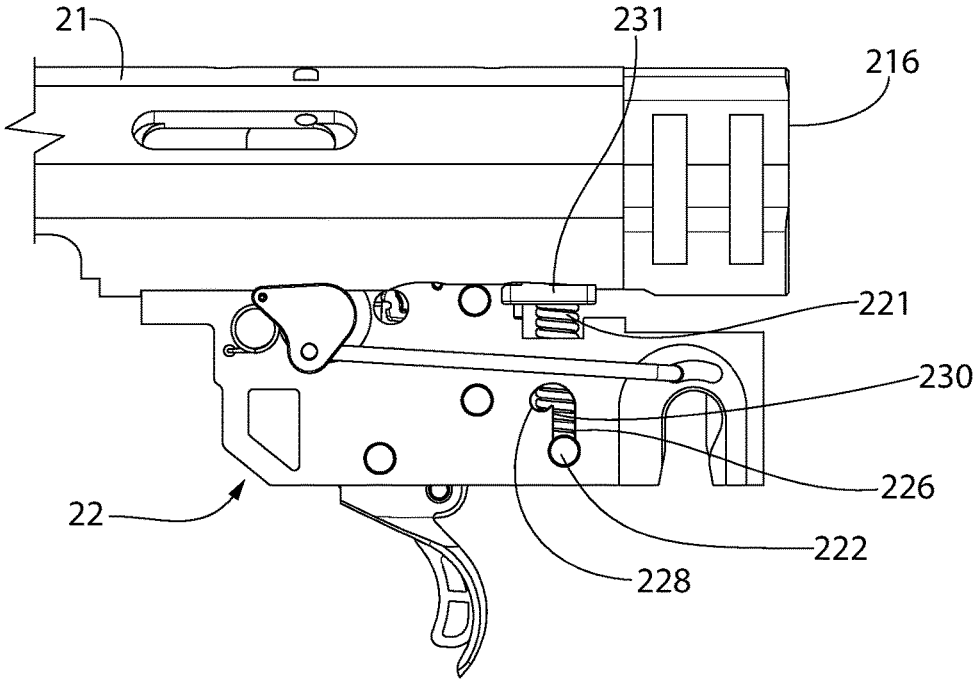
FIG. 39 is a left side view of the receiver and trigger housing showing a lock pin of a locking block assembly in an unlocked position.

Next in the mounting process, the trigger housing 22 is then slid axially forward in the trigger housing mounting slot 212 until the front 203 of the housing contacts the body of receiver 21 at the front end 212*a* of the slot, as shown in FIGS. 35 and 38. The mounting tabs 91*a-d* move forward within undercut slots 214*a*, 214*b* which locates the tabs over and above mating mounting tabs 208*a-d* formed by the receiver 21. This creates an interlocked and engaged or meshed tab arrangement so that the trigger housing 22 can no longer be vertically withdrawn downwards from mounting slot 212. The trigger housing also cannot move upwards due to horizontal partition walls 215*a-b*. The trigger housing 22 is now in a forward non-removable locked position in the trigger housing mounting slot 212, which is shown for example in FIGS. 35 and 38.

Once the trigger housing 22 is slid fully forward in mounting slot 212 of the receiver 21, the spring loaded locking block 220 is vertically aligned with the rear cutouts 213*b* and 213*d* in the receiver. The rear cutouts 213*b* and 213*d* collectively define a transverse width D5 which is slightly larger than the transverse width D4 of the locking block 220 to receive the locking block therethrough. Because the locking block 220 is no longer held in the downward non-blocking position, the spring 221 expands forcing the locking block 220 upward (e.g. locking protrusions 232) via the biasing action of spring through cutouts 213*b* and 213 and entering the mounting slot 212 to fill the void behind the trigger housing 22 vacated by the rear mounting tabs 91*d* and 91*b* of the housing. The locking protrusions 232 thus rise upwards through the cutouts as seen in FIGS. 35 and 38. The trigger housing 22 can no longer slide rearwards within slot 212 which is blocked and prevented engagement between the locking protrusions 232 and peripheral edges 250 of the receiver formed by and within the cutouts 213*b* and 213*d*. In one embodiment, the cutouts 213*b* and 213*d* may collectively form a complementary configuration to the locking protrusions 232 (in top or bottom plan view) to provide a relatively close fit therebetween, thereby preventing rearward movement of the locking block and trigger housing. The locking block 220 is thus now upwards in the blocking position as shown for example in FIGS. 32, 35, 38, and 39-40. It bears noting that the locking protrusions 232 are thus now forward of the open rear end 212*b* of the receiver mounting slot 212.

Figure 40:
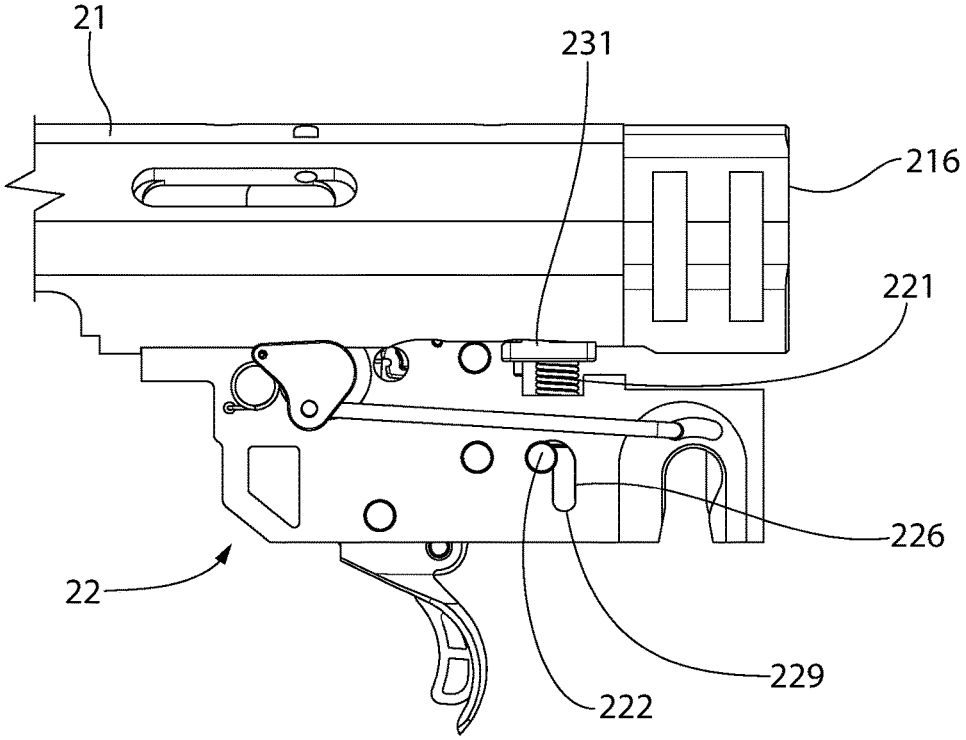
FIG. 40 is a left side view thereof showing the lock pin of the locking block assembly in a locked position.

To next lock the trigger housing 22 in place, the lock pin 222 is raised vertically upwards through the linear track 227 of locking slot 226 and then slid forward into the recurvant top end 228 of the slot. This is shown in FIG. 40. Spring 221 is compressed during the pin movement and final seated location in the recurvant top end of the slot. The lock pin 221 is now in the locked position which prevents downward movement of the locking block 220 sufficient to disengage the trigger housing mounting slot 212 for removing the trigger housing from the receiver. The almost solid height and structure of the spring 221 is configured to physically prevent the locking block from moving down out of engagement with the receiver when the lock pin is raised. The location of the recurvant top end 228 of locking slot 226 is selected so that the locking protrusions 232 on locking block 220 cannot be lowered by an amount which fully disengages the locking block from trigger housing mounting slot 212. Advantageously, the spring 221 and lock pin 222 arrangement helps ensure that the locking block 220 remains engaged with the receiver 21 and cannot loosen or move out of position due to vibrations created by repeated firing of the firearm.

To detach and remove the trigger housing 22 from the receiver 21, a user may perform steps including pulling the locking block 220 downwards against the biasing force of spring 221, withdrawing the locking block from the cutouts 213*b* and 213*d*, sliding the trigger housing rearward to the unlocked position which vertically aligns the mounting tabs 91*a-d* with their mating cutouts 213*a-d*, withdrawing the mounting tabs from the receiver through the cutouts, and finally detaching the trigger housing from the receiver. The mounting rails 231 of the locking block 220 remain exposed and below the receiver 21 when the trigger housing 220 is fully mounted, thereby providing structures for the user to grasp for pulling the locking block downwards to disengage the locking protrusions from the receiver mounting slot 212.

Figure 32:
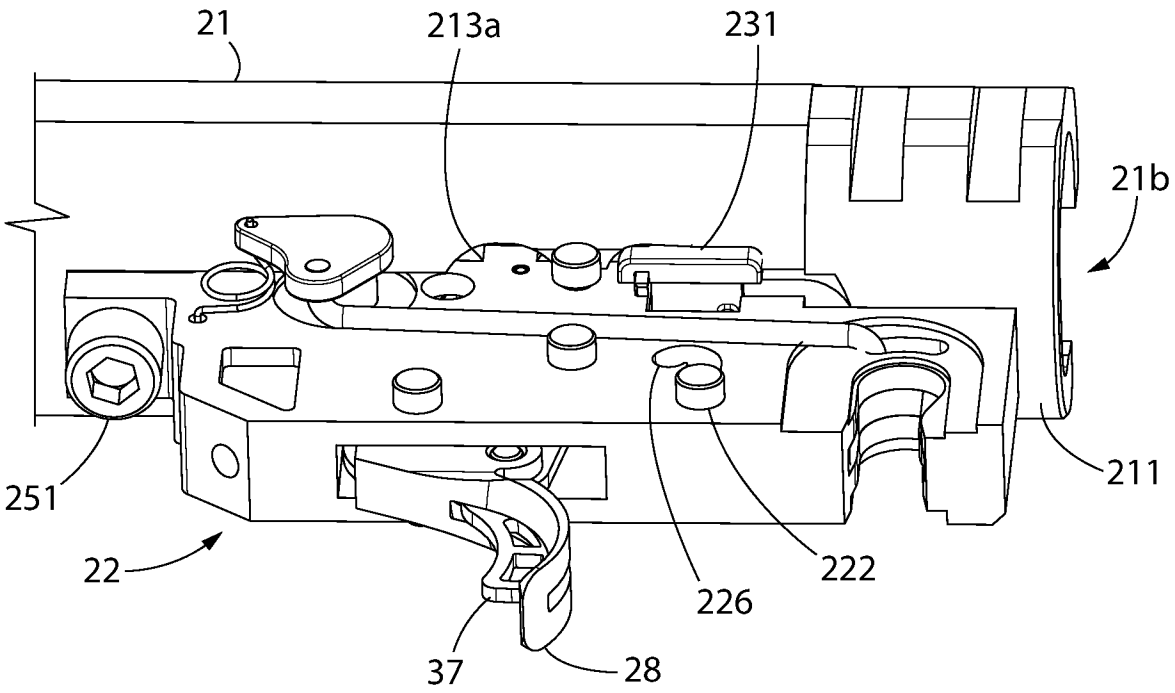
FIG. 32 is a bottom perspective view showing the trigger housing fully mounted to the receiver.

In some embodiments, a secondary securement feature may be provided to further prevent the trigger housing 22 from moving rearward in the mounting slot 212 of the receiver 21. As shown in FIGS. 31 and 32, a threaded fastener 251 may be inserted upwards through hole 92 at the front of the trigger housing 22 once the trigger housing is in the forward locked position to threadably engage a downward open threaded socket 252 formed in the bottom 211 of the receiver 21. In one embodiment, the fastener 251 may be a socket head cap screw as one non-limiting example; however, other types of threaded fasteners may be used instead. A benefit of the spring biased locking block is that it cannot vibrate loose or fall out during repeated firing of the firearm, whether the lock pin is in the unlocked position in the locking slot or especially the locked position.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A trigger housing mounting system for a firearm, the trigger housing mounting system comprising:

a longitudinal axis defining an axial direction;

a receiver defining a downwardly open mounting slot elongated in the axial direction;

first and second receiver tabs disposed on opposite lateral sides of the mounting slot in the receiver;

a trigger housing removably attached to the receiver, the trigger housing having a lower portion and an upper mounting portion comprising first and second trigger housing tabs disposed on opposite lateral sides of the trigger housing, the first and second trigger housing tabs protruding transversely outwards from the upper mounting portion in opposite directions for engaging the first and second receiver tabs;

the upper mounting portion of the trigger housing vertically inserted through the mounting slot, the trigger housing axially slidable forward and rearward in the mounting slot between a locked position in which the first and second trigger housing tabs engage the first and second receiver tabs, and an unlocked position in which the first and second trigger housing tabs disengage the first and second receiver tabs;

a spring-biased locking block movably disposed on the upper mounting portion of the trigger housing, the locking block movable between a lower non-blocking position and an upper blocking position; and a spring biasing the locking block towards the upper blocking position;

wherein the trigger housing is slidable in the mounting slot when the locking block is in the non-blocking position, and the trigger housing is not slidable when the locking block is in the blocking position;

wherein the trigger housing is not removable from the receiver when the trigger housing is in the locked position in which the first and second trigger housing tabs are positioned above the first and second receiver tabs.

2. The trigger housing mounting system according to claim 1, wherein a locking protrusion has a larger transverse width than a corresponding transverse width of the rear end of the mounting slot which prevents the locking protrusion from entering the mounting slot when the locking block is in the lower non-blocking position.

3. The trigger housing mounting systems according to claim 1, further comprising first and second receiver cutouts disposed on opposite lateral sides of the mounting slot in the receiver, the first and second trigger housing tabs being insertable through the receiver cutouts into the receiver.

4. The trigger housing mounting system according to claim 3, wherein the first and second trigger housing tabs collectively define a transverse width which is larger than the transverse width of the mounting slot of the receiver.

5. The trigger housing mounting system according to claim 1, wherein the first and second trigger housing tabs are each slidably received in longitudinally-extending undercut slots formed in the receiver on opposing lateral sides of the mounting slot.

6. The trigger housing mounting system according to claim 5, further comprising horizontal partition walls formed in the receiver on opposing lateral sides of the mounting slot above each of the under slots, the partition walls engaging the first and second trigger housing tabs to limit the insertion depth of the trigger housing into the receiver.

7. The trigger housing mounting system according to claim 6, wherein each partition wall defines longitudinally-extending linear edges within mounting slot, the linear edges being separated by a transverse distance less than a total transverse width of the trigger housing measured between outside edges of the first and second trigger housing tabs thereby preventing insertion of the first and second trigger housing tabs above the partition walls.

8. The trigger housing mounting system according to claim 1, wherein the locking block further comprises a laterally spaced pair of mounting rails arranged to engage opposite lateral sides of the trigger housing, the rails vertically movable relative to the housing when the locking block moves between the blocking and non-blocking positions.

9. The trigger housing mounting system according to claim 8, wherein the mounting rails each include a vertical slot which is slidable upwards and downwards on one of a pair of mating vertical guide bars formed on the opposite lateral sides of the trigger housing.

10. The trigger housing mounting system according to claim 9, further comprising a downward facing abutment surface is disposed at an upper terminal end of each of the guide bars, the abutment surfaces positioned to engage the mounting rails to limit the maximum upward travel of the locking block when moving from the lower non-blocking position to the upper blocking position.

11. The trigger housing mounting system according to claim 1, further comprising:

a lock pin transversely inserted through a locking slot in the trigger housing and acted on by the spring, the locking slot including a bottom end and a recurvant top end;

the lock pin movable between a locked position seated in recurvant top end of the locking slot and an unlocked position seated in the bottom end;

wherein moving the spring from the bottom end to the recurvant top end compresses the spring which prevents movement of locking block from the blocking position to the non-blocking position; and wherein moving the spring from the recurvant top end to the bottom end expands the spring which permits movement of locking block from the blocking position to the non-blocking position.

12. The trigger housing mounting system according to claim 11, further comprising an upwardly turned ledge disposed in the trigger housing adjacent to the recurvant top end in the slot, the ledge operable to retain the lock pin in the recurvant top end.

13. The trigger housing mounting system according to claim 11, wherein the locking lock is J-shaped.

14. A trigger housing mounting system for a firearm, the trigger housing mounting system comprising:

a longitudinal axis defining an axial direction;

a receiver having a body defining a downwardly open mounting slot elongated in the axial direction;

opposing first and second cutouts disposed on opposite lateral sides of the mounting slot in the receiver, the first and second cutouts in communication with the mounting slot;

a trigger housing removably attached to the receiver, the trigger housing having a lower portion and an upper mounting portion comprising opposing first and second mounting tabs protruding transversely outwards from the upper mounting portion in opposite directions for engaging the receiver;

the first and second mounting tabs being insertable through the first and second cutouts and slidably received in the receiver above the mounting slot;

the trigger housing being axially slidable forward and rearward in the mounting slot between a locked position in which first and second mounting tabs are lockingly engaged with and not removable from the receiver, and an unlocked position in which the first and second mounting tabs are vertically aligned with first and second cutouts and removable from the receiver;

a spring-biased locking block movably disposed on the upper mounting portion of the trigger housing, the locking block selectively insertable into and out of the mounting slot of the receiver;

a spring biasing the locking block towards the receiver;

the locking block vertically movable between a lower non-blocking position in which the locking block is inserted in the slot which permits sliding the trigger housing from the locked position to the unlocked position, and an upper blocking position which prevents sliding the trigger housing from the unlocked position to the locked position.

15. The trigger housing mounting system according to claim 14, wherein the locking block has a transverse width larger than a transverse width of the mounting slot which prevents insertion of the locking block into the mounting slot when the locking block is in the lower non-blocking position and the trigger housing is in the unlocked position.

16. The trigger housing mounting system according to claim 15, wherein the first and second cutouts collectively define a transverse width which is slightly larger than the transverse width of the locking block which allows insertion of the locking block into the mounting slot of the receiver.

17. The trigger housing mounting system according to claim 15, wherein the locking block engages an end of the mounting slot when the locking block is in the upper blocking position which prevents sliding of the trigger housing from the locked position to the unlocked position.

18. The trigger housing mounting system according to claim 15, wherein the trigger housing is in a rearward position in the mounting slot when the locking block is in the lower non-blocking position, and the trigger housing is in a forward position in the mounting slot when the locking block is in the upper blocking position.

19. The trigger housing mounting system according to claim 14, further comprising:

opposing third and fourth second cutouts disposed on opposite lateral sides of the mounting slot in the receiver, the third and fourth cutouts in communication with the mounting slot, the third and fourth cutouts longitudinal spaced apart from the first and second cutouts;

opposing third and fourth mounting tabs protruding transversely outwards from the upper mounting portion in opposite directions for engaging the receiver, the third and fourth mounting tabs longitudinally spaced apart from the first and second mounting tabs;

the third and fourth mounting tabs being insertable through the first and second cutouts and slidably received in receiver above the mounting slot;

wherein the third and fourth mounting tabs are lockingly engaged with and not removable from the receiver when the trigger housing is in the locked position, and the first and second mounting tabs are vertically aligned with first and second cutouts and removable from the receiver when the trigger housing is in unlocked position.

* * * * *